US012349858B2

(12) United States Patent
Thorne et al.

(10) Patent No.: US 12,349,858 B2
(45) Date of Patent: Jul. 8, 2025

(54) WASTE RECEPTACLE AND VACUUM CLEANER

(71) Applicant: Origyn LLC, Wayland, MA (US)

(72) Inventors: Jason Thorne, Dover, MA (US); Charles S. Brunner, Portsmouth, NH (US)

(73) Assignee: Origyn LLC, Wayland, MA (US)

( * ) Notice: Subject to any disclaimer, the term of this patent is extended or adjusted under 35 U.S.C. 154(b) by 0 days.

(21) Appl. No.: 18/875,447

(22) PCT Filed: Jun. 16, 2023

(86) PCT No.: PCT/US2023/025518

§ 371 (c)(1),
(2) Date: Dec. 16, 2024

(87) PCT Pub. No.: WO2023/244777

PCT Pub. Date: Dec. 21, 2023

(65) Prior Publication Data

US 2025/0169665 A1 May 29, 2025

Related U.S. Application Data

(60) Provisional application No. 63/417,748, filed on Oct. 20, 2022, provisional application No. 63/390,804,
(Continued)

(51) Int. Cl.
*A47L 9/14* (2006.01)
*A47L 9/12* (2006.01)
(Continued)

(52) U.S. Cl.
CPC ..... *A47L 9/1445* (2013.01); *A47L 9/127* (2013.01); *A47L 9/20* (2013.01); *A47L 9/325* (2013.01)

(58) Field of Classification Search
CPC ..... A47L 9/1445; A47L 9/127; A47L 9/20; A47L 9/325
See application file for complete search history.

(56) References Cited

U.S. PATENT DOCUMENTS 4,593,429 A 6/1986 Dyson
4,826,515 A 5/1989 Dyson
(Continued)

FOREIGN PATENT DOCUMENTS

CN 101744592 A 6/2010
CN 208769686 U 4/2019
(Continued)

OTHER PUBLICATIONS

Written Opinion Corresponding to PCT/US2023/025518 mailed Jun. 4, 2024.
(Continued)

*Primary Examiner* — Marc Carlson
(74) *Attorney, Agent, or Firm* — Finch & Maloney PLLC

(57) ABSTRACT

A vacuum cleaner is described herein that uses an elongated design that provides the various vacuum components along nearly an entire length of the vacuum cleaner and in-line with one another. According to some embodiments, at least one waste receptacle, a filter structure, and a motor are each axially aligned with a longitudinal central axis of a body of the vacuum cleaner. An air suction inlet may also be arranged at a distal end of the body and axially aligned with the longitudinal central axis. In some examples, the body maintains a substantially constant diameter along its entire length.

20 Claims, 18 Drawing Sheets

Related U.S. Application Data filed on Jul. 20, 2022, provisional application No. 63/353,072, filed on Jun. 17, 2022.

(51) Int. Cl.
*A47L 9/20* (2006.01)
*A47L 9/32* (2006.01)

(56) References Cited

U.S. PATENT DOCUMENTS 4,853,008 A 8/1989 Dyson
6,141,826 A 11/2000 Conrad et al.
6,195,835 B1 3/2001 Song et al.
6,334,234 B1 1/2002 Conrad et al.
6,344,064 B1 2/2002 Conrad
6,419,719 B2 7/2002 Conrad et al.
6,582,489 B2 6/2003 Conrad
6,736,873 B2 5/2004 Conrad et al.
6,740,144 B2 5/2004 Conrad et al.
6,782,585 B1 8/2004 Conrad et al.
6,874,197 B1 4/2005 Conrad et al.
6,902,596 B2 6/2005 Conrad et al.
7,179,314 B2 2/2007 Conrad et al.
7,455,708 B2 11/2008 Conrad et al.
7,588,616 B2 9/2009 Conrad et al.
7,681,279 B2 3/2010 Kelly
7,740,675 B2 6/2010 Conrad
7,749,293 B2 7/2010 Conrad
7,776,120 B2 8/2010 Conrad
7,803,207 B2 9/2010 Conrad
7,811,345 B2 10/2010 Conrad
7,867,308 B2 1/2011 Conrad
7,887,612 B2 2/2011 Conrad
7,931,717 B2 4/2011 Conrad
7,941,895 B2 5/2011 Conrad
8,015,659 B2 9/2011 Conrad et al.
8,048,183 B2 11/2011 Conrad
8,146,201 B2 4/2012 Conrad
8,151,407 B2 4/2012 Conrad
8,192,515 B2 6/2012 Conrad
8,236,077 B2 8/2012 Gomiciaga-Pereda et al.
8,250,702 B2 8/2012 Conrad
8,359,705 B2 1/2013 Conrad
8,375,508 B2 2/2013 Conrad
8,486,170 B2 7/2013 Conrad et al.
8,495,789 B2 7/2013 Nicolaou et al.
8,640,303 B2 2/2014 Conrad
8,776,309 B2 7/2014 Conrad
8,863,352 B2 10/2014 Conrad
8,869,344 B2 10/2014 Conrad
8,950,039 B2 2/2015 Conrad
9,066,643 B2 6/2015 Conrad
9,078,549 B2 7/2015 Conrad
9,084,522 B2 7/2015 Conrad
9,084,523 B2 7/2015 Conrad
9,084,524 B2 7/2015 Conrad
9,095,245 B2 8/2015 Conrad
9,119,514 B2 9/2015 Conrad
9,125,538 B2 9/2015 Paliobeis
9,301,662 B2 4/2016 Conrad
9,301,666 B2 4/2016 Conrad
9,414,730 B2 8/2016 Robertson et al.
9,480,378 B2 11/2016 Paliobeis
9,492,045 B2 * 11/2016 Conrad ..... A47L 9/16
9,591,952 B2 3/2017 Conrad
9,918,602 B2 3/2018 Dyson et al.
9,931,005 B2 4/2018 Conrad
9,936,846 B2 4/2018 Conrad et al.
10,085,604 B2 10/2018 Brown et al.
10,149,587 B2 12/2018 Conrad et al.
10,201,260 B2 2/2019 Conrad et al.
10,238,250 B2 3/2019 Conrad
10,251,521 B2 4/2019 Conrad et al.
10,258,210 B2 4/2019 Conrad
10,258,211 B2 4/2019 McLeod
10,327,607 B2 6/2019 Conrad
10,327,610 B2 6/2019 Brown et al.
10,405,708 B2 9/2019 Dimbylow
10,433,686 B2 10/2019 Conrad
10,433,687 B2 10/2019 Dimbylow
10,470,624 B2 11/2019 Dimbylow
10,506,904 B2 12/2019 Conrad et al.
10,537,216 B2 1/2020 Conrad
10,542,856 B2 1/2020 Conrad
10,595,691 B2 3/2020 Dimbylow et al.
10,631,693 B2 4/2020 Conrad
10,660,495 B2 5/2020 Peace
10,702,113 B2 * 7/2020 Conrad ..... A47L 9/1691
10,722,086 B2 * 7/2020 Conrad ..... A47L 9/1641
10,750,913 B2 * 8/2020 Conrad ..... A47L 9/1608
10,750,916 B2 8/2020 Dyson et al.
10,765,278 B2 9/2020 Conrad et al.
10,827,889 B2 * 11/2020 Conrad ..... A47L 9/22
10,828,650 B2 11/2020 Conrad
10,842,330 B2 * 11/2020 Conrad ..... A47L 9/322
10,849,477 B2 12/2020 Conrad et al.
10,869,587 B2 12/2020 Han et al.
10,882,059 B2 1/2021 Conrad
10,893,785 B2 1/2021 Crouch et al.
10,932,634 B2 3/2021 Conrad
10,959,586 B2 3/2021 Conrad et al.
10,959,588 B2 3/2021 Conrad et al.
10,959,858 B2 3/2021 Lewis et al.
10,966,581 B2 4/2021 Innes et al.
10,974,258 B2 * 4/2021 Conrad ..... B04C 5/103
11,013,378 B2 5/2021 Conrad
11,135,602 B2 * 10/2021 Conrad ..... B04C 5/08
11,185,201 B2 11/2021 Conrad et al.
11,235,339 B2 2/2022 Conrad
11,297,987 B2 * 4/2022 Campbell-Hill ..... A47L 9/1666
11,382,470 B2 * 7/2022 Hinchliffe ..... A47L 9/1666
11,445,875 B2 9/2022 Conrad
2006/0156508 A1 7/2006 Khalil
2010/0229323 A1 9/2010 Conrad
2013/0091810 A1 4/2013 Smith
2014/0237756 A1 8/2014 Conrad
2016/0174787 A1 * 6/2016 Conrad ..... A47L 5/225 15/329
2017/0071426 A1 3/2017 Krebs et al.
2017/0135539 A1 5/2017 Regina
2017/0196419 A1 7/2017 Brown et al.
2017/0196420 A1 7/2017 Brown et al.
2017/0319026 A1 11/2017 Roschi
2019/0008343 A1 * 1/2019 Conrad ..... A47L 9/246
2019/0090701 A1 * 3/2019 Tonderys ..... A47L 9/2884
2019/0320862 A1 10/2019 Conrad
2019/0320863 A1 10/2019 Conrad
2020/0163507 A1 5/2020 Percy-Raine et al.
2020/0305664 A1 10/2020 Conrad
2021/0219798 A1 7/2021 Innes et al.
2021/0290011 A1 9/2021 Conrad
2021/0401248 A1 * 12/2021 King ..... A47L 5/24
2022/0007904 A1 1/2022 Conrad
2022/0151446 A1 * 5/2022 Conrad ..... A47L 9/1666

FOREIGN PATENT DOCUMENTS

CN 109984671 A 7/2019
CN 110831472 A 2/2020
CN 107969989 B 5/2021
CN 109984670 B 5/2021
CN 113197509 A 8/2021
CN 110720856 B 9/2021
CN 110013709 B 3/2022
CN 112969393 B 6/2022
DE 651 326 C 10/1937
DE 1503778 A1 1/1970
DE 20 2005 007 213 U1 8/2005
DE 21 2017 000 236 7/2019
EP 1031312 A1 8/2000
EP 2378938 A1 10/2011
EP 2910167 A1 8/2015
EP 2954813 A1 12/2015
EP 3075297 A1 10/2016

(56) References Cited

FOREIGN PATENT DOCUMENTS

| | | | | | |
|---|---|---|---|---|---|
| EP | 3528684 | A1 | | 8/2019 | |
| EP | 3566628 | A1 | | 11/2019 | |
| EP | 3727115 | A1 | | 10/2020 | |
| GB | 2466290 | A1 | | 6/2010 | |
| GB | 2569569 | A1 | | 6/2019 | |
| GB | 2569818 | A1 | | 7/2019 | |
| GB | 2569821 | A1 | | 7/2019 | |
| GB | 2578873 | A1 | | 6/2020 | |
| GB | 2578250 | B2 | | 11/2020 | |
| GB | 2586995 | A1 | | 3/2021 | |
| GB | 2591588 | A1 | | 8/2021 | |
| GB | 2591589 | A1 | | 8/2021 | |
| JP | S49-62956 | U | | 6/1974 | |
| JP | H07-12048 | U | | 2/1995 | |
| JP | H10-248767 | A | | 9/1998 | |
| JP | H11-019008 | A | | 1/1999 | |
| KR | 10-1999-0074966 | A | | 10/1999 | |
| KR | 10-0577679 | B1 | | 5/2006 | |
| KR | 10-2018-0078076 | A | | 7/2018 | |
| KR | 20180078076 | A | * | 7/2018 | |
| WO | 1999/030602 | A2 | | 6/1999 | |
| WO | 1999/030604 | A1 | | 6/1999 | |
| WO | 2001/097673 | A1 | | 12/2001 | |
| WO | 2002/096257 | A1 | | 12/2002 | |
| WO | 2004/069021 | A1 | | 8/2004 | |
| WO | 2014/001496 | A1 | | 1/2014 | |
| WO | 2019/006543 | A1 | | 1/2019 | |
| WO | 2019/122802 | A1 | | 6/2019 | |
| WO | 2019/130012 | A1 | | 7/2019 | |
| WO | WO-2020022710 | A1 | * | 1/2020 | ..... A47L 9/2873 |
| WO | 2020/184874 | A1 | | 9/2020 | |
| WO | 2021/156590 | A1 | | 8/2021 | |
| WO | WO-2022096854 | A1 | * | 5/2022 | ..... A47L 5/225 |

OTHER PUBLICATIONS

International Search Report Corresponding to PCT/US2023/025518 mailed Nov. 16, 2023.

International Search Report and Written Opinion Corresponding to PCT/US2023/025517 mailed Oct. 16, 2023.

International Preliminary Report on Patentability Corresponding to PCT/US2023/025518 mailed Aug. 29, 2024.

International Search Report Corresponding to PCT/US2023/025519 mailed Mar. 18, 2024.

Written Opinion Corresponding to PCT/US2023/025519 mailed Mar. 18, 2024.

* cited by examiner

WASTE RECEPTACLE AND VACUUM CLEANER

This application is a U.S. National Stage Entry of International Application No. PCT/US2023/025518, filed Jun. 16, 2023, which claims the benefit of U.S. Provisional Application No. 63/353,072, filed Jun. 17, 2022, U.S. Provisional Application No. 63/390,804, filed Jul. 20, 2022, and U.S. Provisional Application No. 63/417,748, filed Oct. 20, 2022, the disclosures of which are incorporated by reference herein in their entireties.

BACKGROUND

Cleaning tools such as vacuum cleaners have been used for decades to aid in cleaning dirt and other debris from floors. Most vacuum cleaners have a built-in motor to facilitate air suction and an area to collect dirt, but the units are often heavy and bulky, thus making it difficult to deftly maneuver the unit around a given floorspace. Accordingly, there exist some drawbacks and other unsolved issues that limit the convenience of vacuum cleaners.

SUMMARY

As noted above, there are some non-trivial issues with the designs of most vacuum cleaners. Many of the issues pertain to matters of convenience for the user. For example, vacuum cleaners are often difficult to maneuver around and under furniture or other obstacles. Additionally, the vacuum components such as a waste receptacle, filters, and a motor are often jammed together in a cramped space in an effort to reduce the weight, but at the cost of efficiency. Accordingly, some vacuum cleaner embodiments are described herein that use a unique elongated design that provides the various vacuum components along nearly an entire length of the vacuum cleaner and in-line with one another. According to some embodiments, at least one waste receptacle, a filter structure, and a motor are each axially aligned with a longitudinal central axis of a body of the vacuum cleaner. An air suction inlet may also be arranged at a distal end of the body and axially aligned with the longitudinal central axis. According to some embodiments, the body may have a substantially constant cross-sectional area along its entire length, and the length of the body is at least 50%, at least 60%, at least 75%, or at least 90% the entire length of the vacuum cleaner. As used herein, a substantially constant cross-sectional area, as it pertains to the vacuum body, is an area that changes by, at most, 10% along the length of the body. In some embodiments, the body is cylindrical such that the body maintains a substantially constant diameter along its entire length, and the length of the cylindrical body is at least 50%, at least 60%, at least 75%, or at least 90% the entire length of the vacuum cleaner. As used herein, a substantially constant diameter, as it pertains to the diameter of the vacuum body, is a diameter that changes by, at most, 10% along the length of the body. In other embodiments, there may be separate portions along the length of the vacuum cleaner that interrupt the constant diameter or constant cross-sectional area, however, the portions that do exhibit the constant diameter or constant cross-sectional area will be spaced along the length of the vacuum by at least 50%, 60%, 75%, or 90% the entire length of the vacuum cleaner.

The vacuum cleaner described herein includes numerous other useful features that provide an advantage over conventional designs. For example, the vacuum cleaner includes a hidden hinge along the length of its body that allows the body to be split into two sections about the hinge. As suggested by the name, the hinge may be located completely within the body such that no part of the hinge mechanism extends beyond the diameter of the body. According to some embodiments, the separation of the body sections also breaks an air suction pathway between the two sections. In some embodiments, a first body section is rotated away from a second section body section such that it can rest substantially parallel and adjacent to the second body section. In its folded configuration, the vacuum is about half its working length and can be stored in a small space. As used herein, two elongated objects that are "substantially parallel" to one another refers to the objects being within +−10 degrees of perfectly parallel to one another.

In some examples, the vacuum cleaner includes a filter arrangement that includes a cylindrical pre-filter and a cylindrical post filter within the cylindrical body of the vacuum cleaner. Each of the pre- and post-filter may be axially aligned with the longitudinal central axis of the cylindrical body of the vacuum cleaner. In some embodiments, the pre filter is concentrically arranged within the post filter to provide more efficient usage of the space within the body.

In some examples, the vacuum cleaner includes an in-line handle design that allows the user to grip the vacuum and maneuver it around as if the vacuum cleaner body were a continuous linear extension of their arm. According to some embodiments, the handle includes a grip that extends between first and second brackets. Each of the first bracket and the second bracket extends away from the proximal end of the body and substantially parallel to the longitudinal central axis of the body.

In some examples, the vacuum cleaner includes a waste receptacle design having two housing portions with one housing portion designed to axially slide within the other housing portion. According to some embodiments, the second housing portion can slide into the first housing portion (which may remain fixed) in order to push debris down into the first housing portion and clean any debris from accumulating along an air suction tube within the waste receptacle. A door at one end of the waste receptacle may be configured to swing open about a hinge in response to the second housing portion sliding into the first housing portion. In some embodiments, a handle may be coupled to a top wall of the second housing portion and coupled to the air suction tube, such that pulling on the handle also moves the top wall and air suction tube axially in an opposite direction to the movement of the second housing portion.

According to an embodiment, a vacuum cleaner includes a cylindrical body having a longitudinal central axis and a substantially constant diameter along an entire length of the body extending from a proximal end to a distal end, a waste receptacle within the body and adjacent to the distal end of the body, an air suction inlet at the distal end of the body, and a motor housed in the body between the waste receptacle and the proximal end of the body. Each of the waste receptacle, the air suction inlet, and the motor are axially aligned with the longitudinal central axis of the cylindrical body.

According to another embodiment, a vacuum cleaner includes a cylindrical body having a substantially constant diameter along an entire length of the body extending from a proximal end to a distal end. The body has a first section and a second section along its length. The vacuum cleaner further includes a hinge mechanism located within the body such that the first section of the body is connected to the second section of the body via the hinge mechanism, a first air suction passageway within or on the first section of the body, and a second air suction passageway within or on the second section of the body. The first air suction passageway is connected to the second air suction passageway when the hinge mechanism is in an unfolded state such that first section of the body is aligned lengthwise along the same central axis as the second section of body. There is a break between the first air suction passageway and the second air suction passageway when the hinge mechanism is in a folded state such that the second section of the body is rotated away from the first section of the body.

According to another embodiment, a vacuum cleaner includes a cylindrical body, a motor disposed within the body and aligned centrally to a longitudinal axis passing through the center of the body, and a filter structure disposed adjacent to the motor and within the body. The filter structure includes a cylindrical pre-filter having a first diameter and a cylindrical post-filter disposed around the cylindrical pre-filter. The cylindrical post-filter has a second diameter greater than the first diameter.

According to an embodiment, a vacuum cleaner includes a cylindrical body having a longitudinal central axis, a waste receptacle within the cylindrical body, and an air suction tube extending through at least a portion of the waste receptacle. The waste receptacle includes a first housing section, a second housing section, and a slider grip coupled to the first housing section. The first housing section is designed to fit within the second housing section. Movement of the slider grip along a track causes a corresponding movement of the first housing section relative to the second housing section.

According to an embodiment, a waste receptacle is designed for use on a vacuum cleaner. The waste receptacle includes a first cylindrical housing section having a first diameter, a second cylindrical housing section having a second diameter larger than the first diameter, and a slider grip coupled to the first cylindrical housing section. The first cylindrical housing section is configured to fit within the second cylindrical housing section. Movement of the slider grip along a track causes a corresponding movement of the first cylindrical housing section relative to the second cylindrical housing section.

These and other such embodiments will be described in more detail herein.

BRIEF DESCRIPTION OF THE DRAWINGS

Features and advantages of embodiments of the claimed subject matter will become apparent as the following Detailed Description proceeds, and upon reference to the Drawings, in which:

Although the following Detailed Description will proceed with reference being made to illustrative embodiments, many alternatives, modifications, and variations thereof will be apparent in light of this disclosure.

DETAILED DESCRIPTION

The description uses the phrases "in an embodiment" or "in embodiments," which may each refer to one or more of the same or different embodiments. Furthermore, the terms "comprising," "including," "having," and the like, as used with respect to embodiments of the present disclosure, are synonymous. When used to describe a range of dimensions, the phrase "between X and Y" represents a range that includes X and Y.

Spatially relative terms, such as "beneath," "below," "lower," "above," "upper," and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 1:
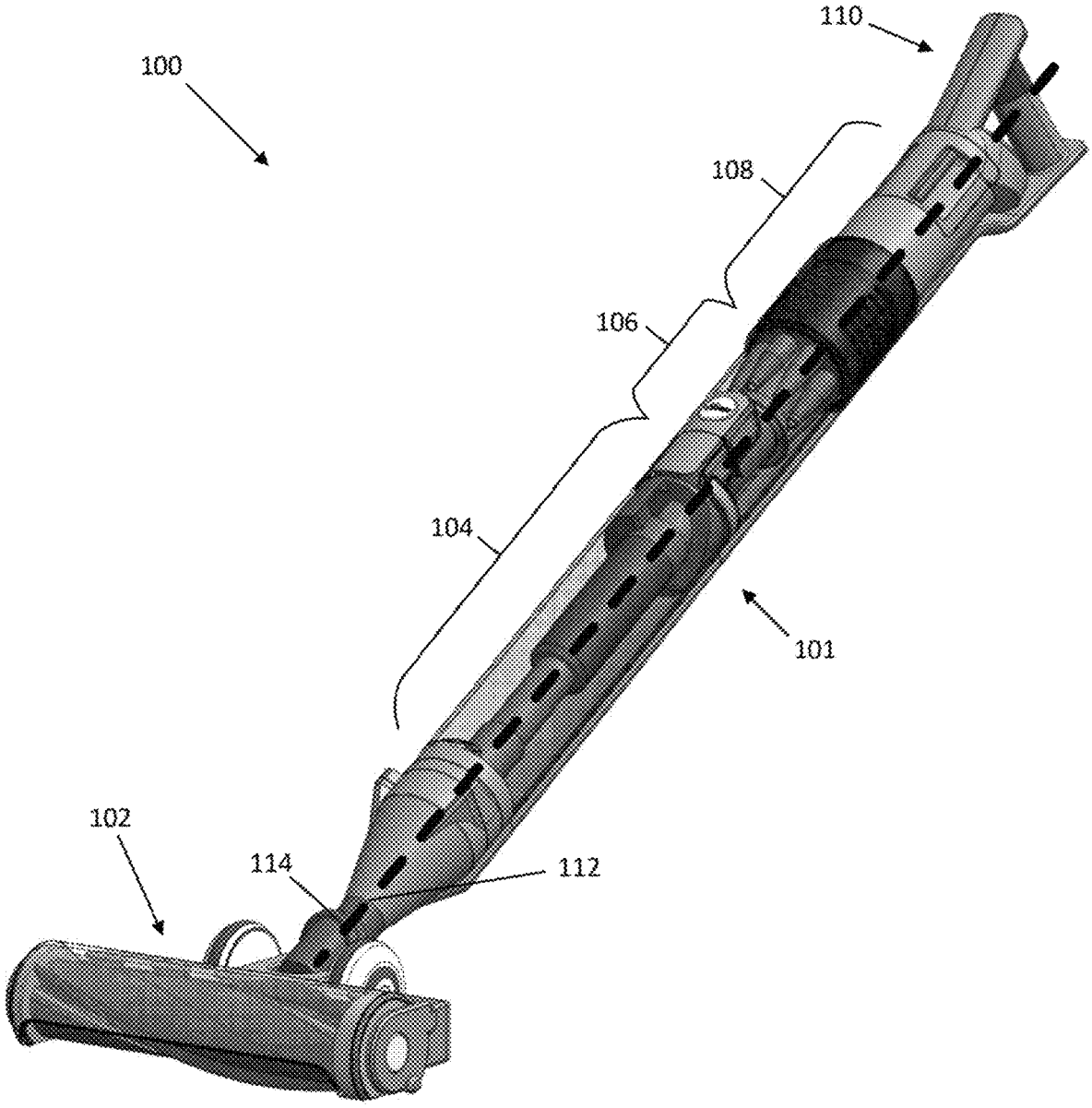
FIG. 1 illustrates an isometric, three-dimensional view of a vacuum cleaner, in accordance with some embodiments of the present disclosure.

FIG. 1 illustrates a perspective three-dimensional view of a vacuum cleaner 100, according to an embodiment. Vacuum cleaner 100 has the general shape of a stick vacuum, however, it includes a cylindrical body 101 that extends along nearly an entire length of vacuum cleaner 100. In some embodiments, cylindrical body 101 has a substantially constant diameter along its entire length that is between about 3" and about 6", or between about 4" and about 5". Cylindrical body 101 may have a total length between a proximal end and a distal end of between about 2' and about 3'. In some embodiments, a nozzle assembly 102 may be coupled to the distal end of cylindrical body 101 while a handle 110 may be coupled to a proximal end of cylindrical body 101. Nozzle assembly 102 can include a rotatable brush head or any other type of cleaning head for facilitating the gathering of debris from the floor or other surfaces.

According to some embodiments, body 101 includes one or more sections along its length. Each of the various sections may house certain vacuum components and provide one or more air suction pathways up through body 101. For example, body 101 can include a first section 104, a second section 106, and a third section 108, each aligned axially along a longitudinal central axis 112 of body 101. According to some embodiments, longitudinal central axis 112 also extends through a grip portion of handle 110 at the proximal end of cylindrical body 101. In some embodiments, each of sections 104-108 may be designed to be modular such that they can be separated from one another for maintenance or to replace one or more parts. In some embodiments, first section 104 may be coupled to the remaining sections (e.g., sections 106 and 108) via a hinge that allows second section 106 to separate from first section 104 about the hinge. Further details of the hinge are provided herein.

According to some embodiments, the length of body 101 (e.g., including each of the body sections) takes up a majority of the entire length of vacuum cleaner 100 (including nozzle assembly 102, body 101, and handle 110). For example, the length of body 101 may be at least 50%, at least 60%, at least 70%, at least 75%, at least 80%, or at least 90% the entire length of vacuum cleaner 100. This design is in contrast with other stick vacuums where a suction tube extends away from a primary body section and makes up a majority of the length of the vacuum cleaner.

According to some embodiments, first section 104 of body 101 includes a waste receptacle and is longer than either of second section 106 or third section 108. In some embodiments, first section 104 of body 101 has a length that is at least 30%, at least 40% or at least 50% of the total length of body 101. According to some embodiments, an air suction tube extends either through the waste receptacle within first section 104 or along an outside surface of the waste receptacle, as will be discussed in more detail herein.

Second section 106 of body 101 may include an additional waste receptacle designed to collect finer debris compared to the waste receptacle of first section 104. Second section 106 may be directly adjacent to first section 104 along the length of body 101. The finer debris may be collected by passing the suctioned air through one or more cyclonic structures within second section 106. The waste receptacle of second section 106 may be fluidically connected via an airflow path with the waste receptacle of first section 104.

According to some embodiments, third section 108 may be directly adjacent to second section 106 and may include the power components of vacuum cleaner 100, such as the motor and energy storage devices. A filter structure may be included with the motor to provide filtration of air both before and after it has passed through the motor. As discussed above, both the filter structure and the motor may be axially aligned with longitudinal central axis 112 within body 101. For example, longitudinal central axis 112 may pass through the central axis of rotation of the motor. According to some embodiments, the components of third section 108 constitute the majority of the weight of vacuum cleaner 100.

According to some embodiments, nozzle assembly 102 includes a pivot mechanism 114 about which body 101 can move and/or twist relative to the brush head. Pivot mechanism 114 may be any known pivoting structure that allows for a large dynamic range of movement, such as a ball-in-socket joint. According to some embodiments, pivot mechanism 114 is aligned along longitudinal central axis 112.

Each of sections 104-108 of body 101 may be formed from injection molded plastic or from any suitably rigid plastic material. In some embodiments, a clear or translucent plastic may be used for body section 104 to allow for visual inspection of the waste receptacle within section 104. In some embodiments, vacuum cleaner 100 only includes a single waste receptacle (e.g., located within first section 104) and thus third section 108 may be expanded to encompass second section 106. In this way, body 101 may be considered as having only two sections with third section 108 being adjacent to first section 104 (e.g., no second section 106).

Figure 2A:
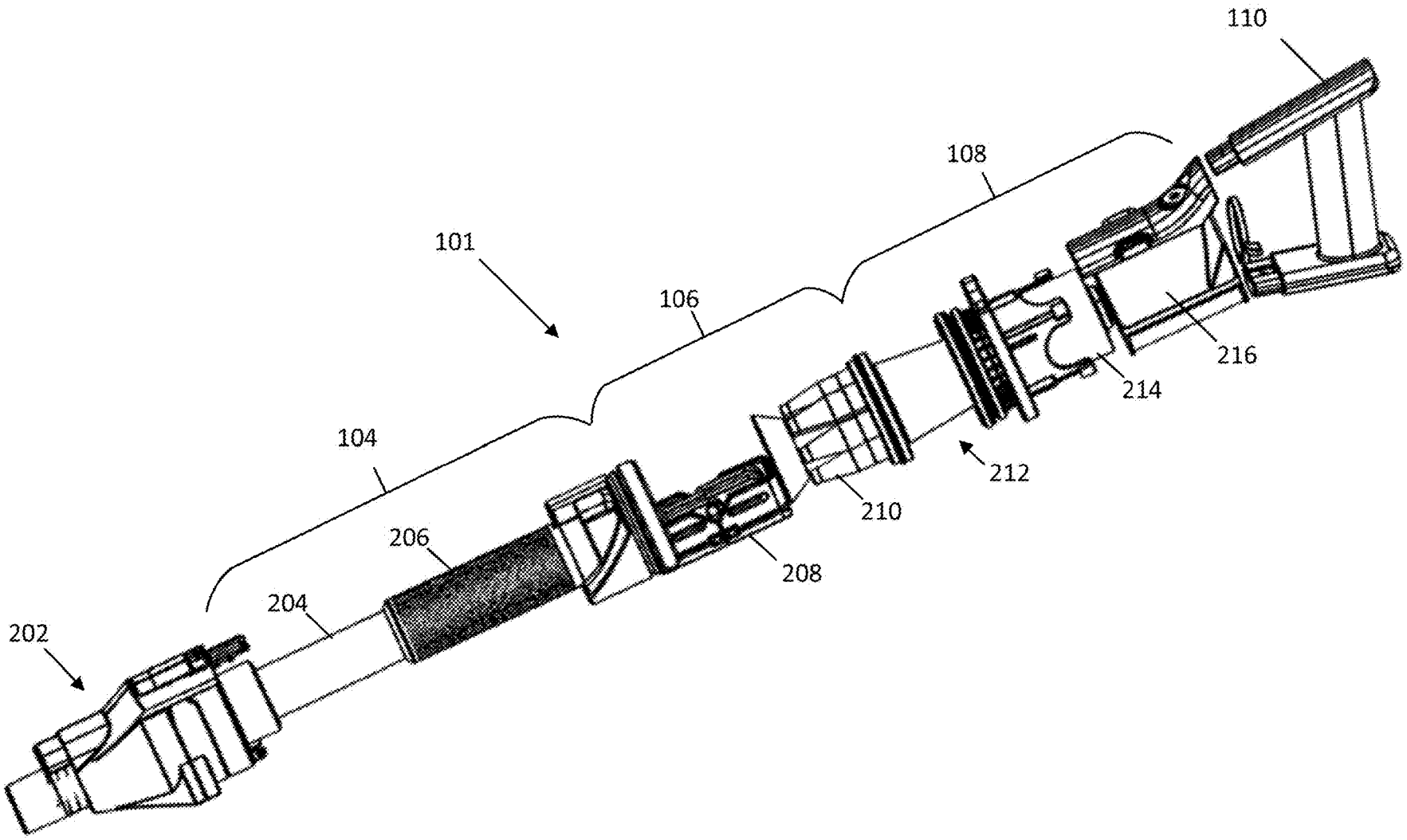
FIG. 2A illustrates a three-dimensional cut-away view of the vacuum cleaner, in accordance with some embodiments of the present disclosure.

FIG. 2A illustrates a view of several of the components within vacuum cleaner 100 along the length of body 101 with the outside covers of each of the sections removed, according to some embodiments. Note that, in some embodiments, only some of the illustrated components may be present within vacuum cleaner 100. According to some embodiments, various ones of the components may each be centrally aligned to the longitudinal central axis of body 101.

According to some embodiments, a nozzle coupling structure 202 is coupled to a distal end of body 101 (e.g., adjacent to first section 104). Nozzle coupling structure 202 may neck down from a diameter of body 101 to a smaller diameter that interfaces with a cleaning head. Nozzle coupling structure 202 may be an integral part of nozzle assembly 102, such that nozzle coupling structure 202 and the cleaning brush head are one unit that is removably coupled to the distal end of body 101. Accordingly, nozzle coupling structure 202 includes an air suction pathway through, for example, a central portion of its structure. The air suction pathway through nozzle coupling structure 202 may be in fluidic communication with an air suction inlet at the distal end of body 101.

According to some embodiments, first section 104 of body 101 includes a first air suction tube 204 and a mesh or screen 206 that wraps around a second air suction tube. According to some embodiments, air along with any collected debris is sucked up through first air suction tube 204 and into the first waste receptacle within first section 104. According to some embodiments, the first waste receptacle is defined by the volume in first section 104 around any components such as air suction tube 204 and mesh or screen 206. After being pulled into the first waste receptacle, the air continues to pass through mesh or screen 206 where it is sucked up through the second air suction tube inside of mesh or screen 206 towards second section 106 of body 101. Mesh or screen 206 may be a wire mesh or similar mesh-like structure that prevents larger debris (e.g., larger than the mesh size) from passing through mesh or screen 206. Any larger debris that cannot pass through mesh or screen 206 is collected within the first waste receptacle of first section 104. According to some embodiments, first air suction tube 204 is axially aligned along the central longitudinal axis of body 101. In some other embodiments, first air suction tube 204 runs along an outside surface of body 101 along a length of first section 104, as discussed in more detail herein.

As noted above, the suctioned air passes through mesh or screen 206 and towards second section 106 via a second air suction tube. According to some embodiments, second section 106 includes a second waste receptacle in a volume around a hinge 208. The suctioned air may first pass through one or more cyclonic separators 210 designed to remove smaller debris (e.g., dust particles) from the air and capture the smaller debris within the second waste receptacle. The suctioned air continues onward, after passing through cyclonic separators 210, to third section 108.

According to some embodiments, hinge 208 is a hidden hinge design that allows the entire portion of body 101 above first section 104 to separate and rotate away from first section 104 about hinge 208. According to some embodiments, hinge 208 is designed to be completely encompassed within body 101 in its unfolded state (as illustrated in FIG. 2A). Further details regarding hinge 208 and its operation are provided herein with reference to FIGS. 3A, 3B, and 4.

According to some embodiments, third section 108 of body 101 includes a filter structure 212, a motor 214, and a battery pack 216. Filter structure 212 includes both a pre-filter and a post-filter arranged in the flow path of the air, according to some embodiments. Briefly, the suctioned air passes through the pre-filter before it is drawn through motor 214 and is exhausted from motor 214 and passes through the post-filter before being vented away from the vacuum cleaner. Both the pre- and post-filter may be cylindrical in shape and axially aligned along the central longitudinal axis of body 101. Accordingly, one filter may be concentrically arranged within the other. Motor 214 may be any suitable vacuum motor, such as a universal motor, that draws air up through the various sections of body 101. According to some embodiments, motor 214 has between 200 and 250 airwatts (AW) of suction. Battery pack 216 may hold any number of energy storage devices. The energy storage devices may be rechargeable batteries that are designed to remain within battery pack 216 and be charged externally. In some other examples, the energy storage devices are replaceable batteries (such as AA, AAA, C, or D batteries) that can be accessed and removed/replaced by the user.

Figure 2B:
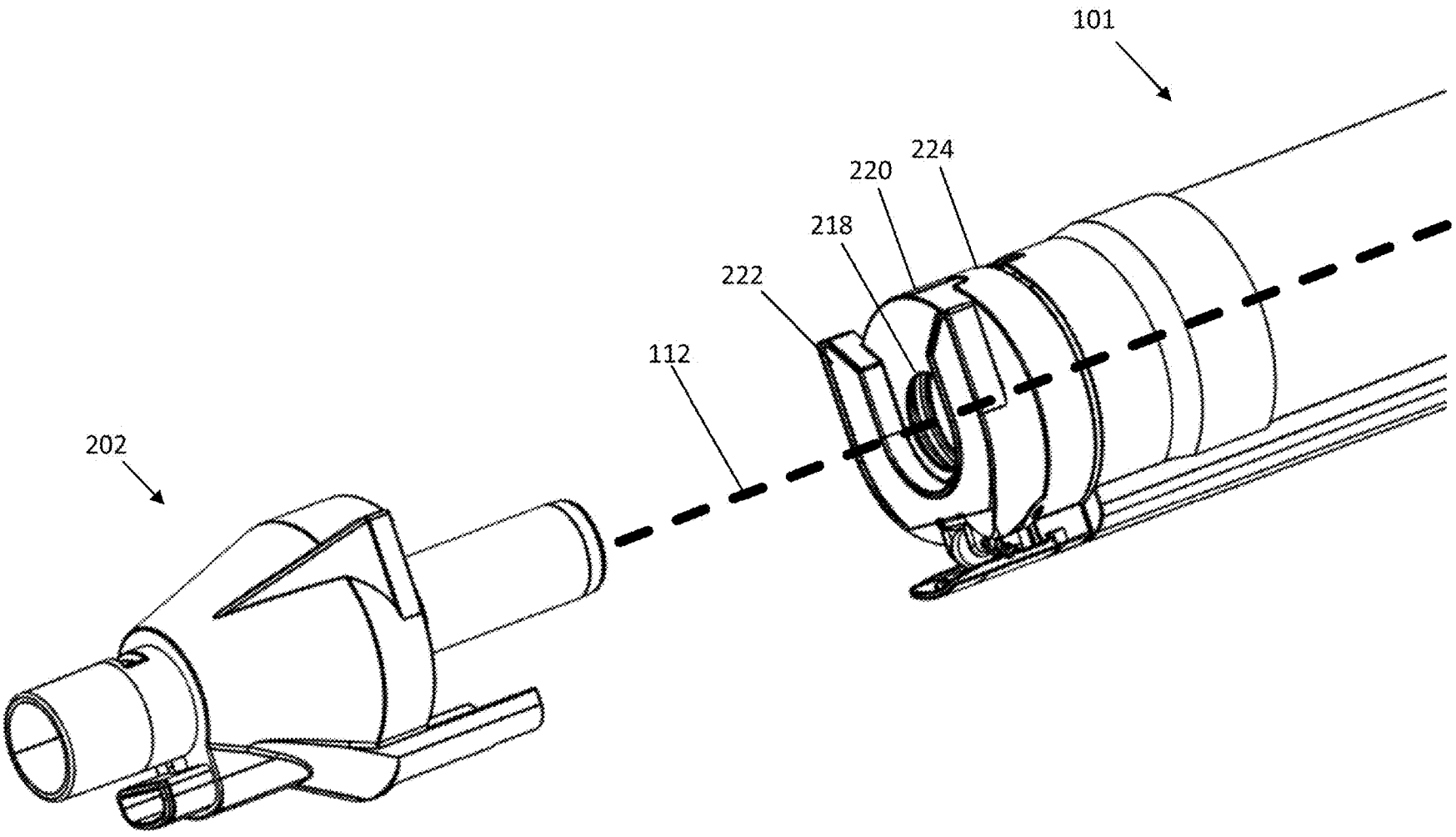
FIG. 2B illustrates a three-dimensional view of a distal portion of the vacuum cleaner, in accordance with some embodiments of the present disclosure.

FIG. 2B illustrates a closer view of the distal end of body 101 after removing nozzle coupling structure 202. According to some embodiments, an air suction inlet 218 is present at the distal end of body 101. Air suction inlet 218 may be axially aligned along central longitudinal axis 112. According to some embodiments, at least a portion of nozzle coupling structure 202 interfaces with air suction inlet 218 to create an airflow path through nozzle coupling structure 202 and into air suction inlet 218. Air that is sucked into air suction inlet 218 passes into first air suction tube 204 of first section 104, according to some embodiments.

According to some embodiments, the removal of nozzle coupling structure 202 from the distal end of body 101 exposes a foot structure 220 around air suction inlet 218. Foot structure 220 may include a horse-shoe structure 222 that can be used to guide debris into air suction inlet 218 as foot structure 220 is guided along the ground. The distal end of body 101 also includes a waste receptacle door 224 that can be released to swing open about a hinge at one end to empty the contents of the first waste receptacle in first section 104 of body 101.

Figure 3B:
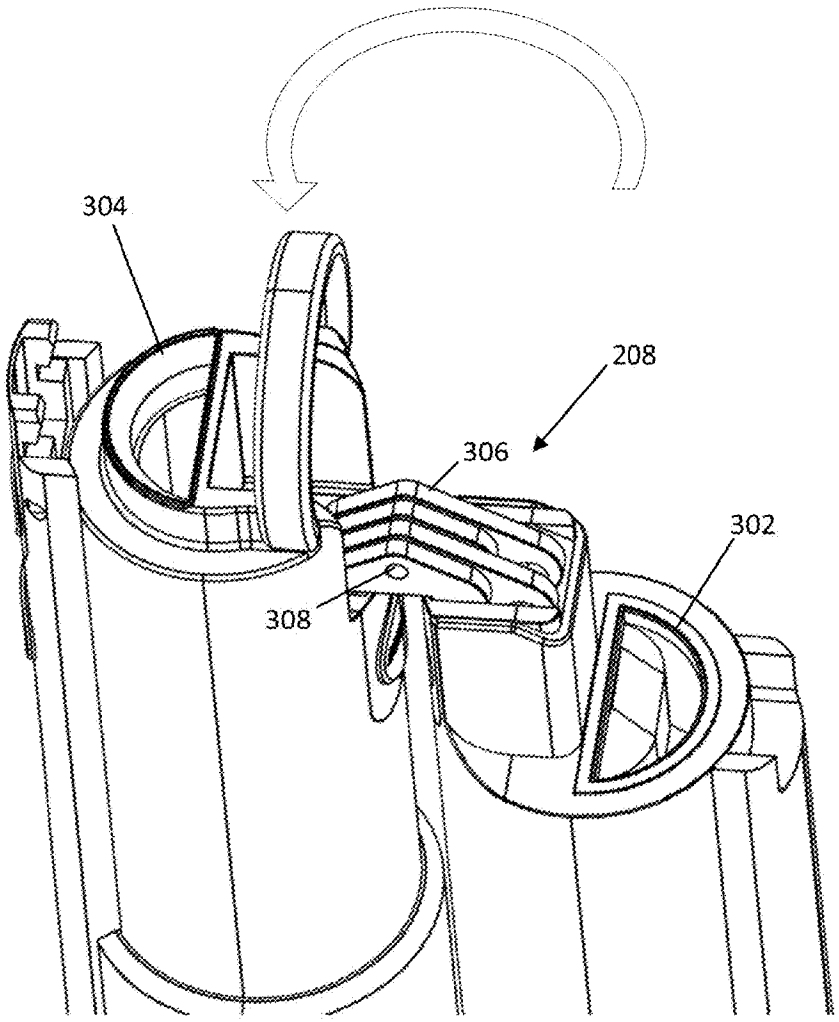
FIGS. 3A and 3B, illustrate three-dimensional views of a vacuum cleaner in a folded position, in accordance with some embodiments of the present disclosure.
Figure 3A:
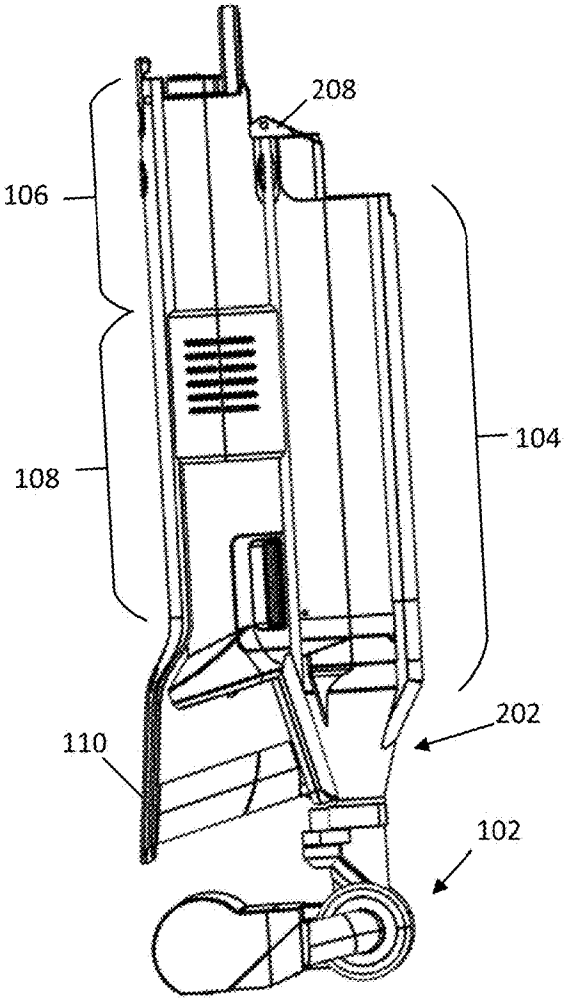

FIGS. 3A and 3B illustrate different views of vacuum cleaner 100 in a folded configuration about hinge 208, according to some embodiments. As shown in FIG. 3A, body 101 has been split nearly in half such that first section 104 is separated from any remaining sections (e.g., sections 106 and 108) via rotation about hinge 208. According to some embodiments, second section 106 rotates about hinge 208 such that the longitudinal central axis of second section 106 is substantially parallel with the longitudinal central axis of first section 104. In this context, substantially parallel means that the longitudinal central axis of second section 106 and first section 104 are within 10 degrees of being parallel with one another. In some examples, second section 106 and third section 108 may be considered a single section, such that rotation occurs between first section 104 and the combined single section that includes both sections 106 and 108.

According to some embodiments, the rotation of the different body sections about hinge 208 may cause handle 110 to rest either against or directly adjacent to nozzle coupling structure 202. For example, the angled shape of handle 110 may fit against the angled taper of nozzle coupling structure 202.

The entire vacuum cleaner may rest on the floor in an upright position on nozzle assembly 102 when in the folded state illustrated in FIG. 3A. In the folded state, the center of gravity of the vacuum is shifted so that it resides above a central portion of nozzle 102, providing vertical stability in the folded state. This can be useful for storage purposes as it decreases the total length of the vacuum cleaner while still allowing it to stand on its own.

FIG. 3B provides a closer look of hinge 208 and the adjacent body sections while the vacuum cleaner (and hinge 208) is in the folded configuration. According to some embodiments, a first air suction passageway 302 at an end of first section 104 mates with a second air suction passageway 304 at an end of second section 106 to provide a closed airpath between first section 104 and second section 106 when hinge 208 is in its unfolded state (e.g., when each of first section 104 and second section 106 are aligned along the same longitudinal central axis.) However, according to some embodiments, the air flow path between first air suction passageway 302 and second air suction passageway 304 is broken when hinge 208 is in its folded state (e.g., when second section 106 is rotated away from first section 104). The shape of the openings for each of first air suction passageway 302 and second air suction passageway 304 may be crescent or semicircular, as illustrated, or any other suitable shape that allow the passageways to fit together when hinge 208 is folded and provides a substantially airtight seal when in its operating state. As noted above, second air suction passageway 304 may lead to one or more cyclonic structures within second section 106 designed to separate dust and other small particles from the airstream to be deposited in a second waste receptacle. In some other examples, the second waste receptacle is omitted, and second air suction passageway 304 leads directly to one or more pre-filters before encountering the motor.

It should be understood that hinge 208 can be utilized within any type of vacuum cleaner to fold between two sections of the vacuum cleaner. For example, hinge 208 can be used within any standard upright vacuum cleaner, any stick vacuum cleaner, or any canister vacuum cleaner. Also, hinge 208 in FIG. 3A is configured to fold the vacuum cleaner in a front-to-back arrangement, but hinge 208 could be designed to fold the vacuum cleaner in any other direction, such as directly sideways relative to front-facing direction of nozzle assembly 102.

In some embodiments, hinge 208 not only allows the folded vacuum body portions to be substantially parallel but provides no interference between the two body portions. For example, when in the folded configuration, the shortest distance between the outer surfaces of the two body sections, at the hinged end, can be less than 10 mm, less than 5 mm, less than 2 mm or less than 1 mm. For instance, the outer surfaces of the portions that are joined together at hinge 208 can be in contact with each other when the vacuum is folded. This means that in some embodiments the folded configuration takes up no more than twice the horizontal space as the unfolded (e.g., fully extended) configuration.

Figure 4:
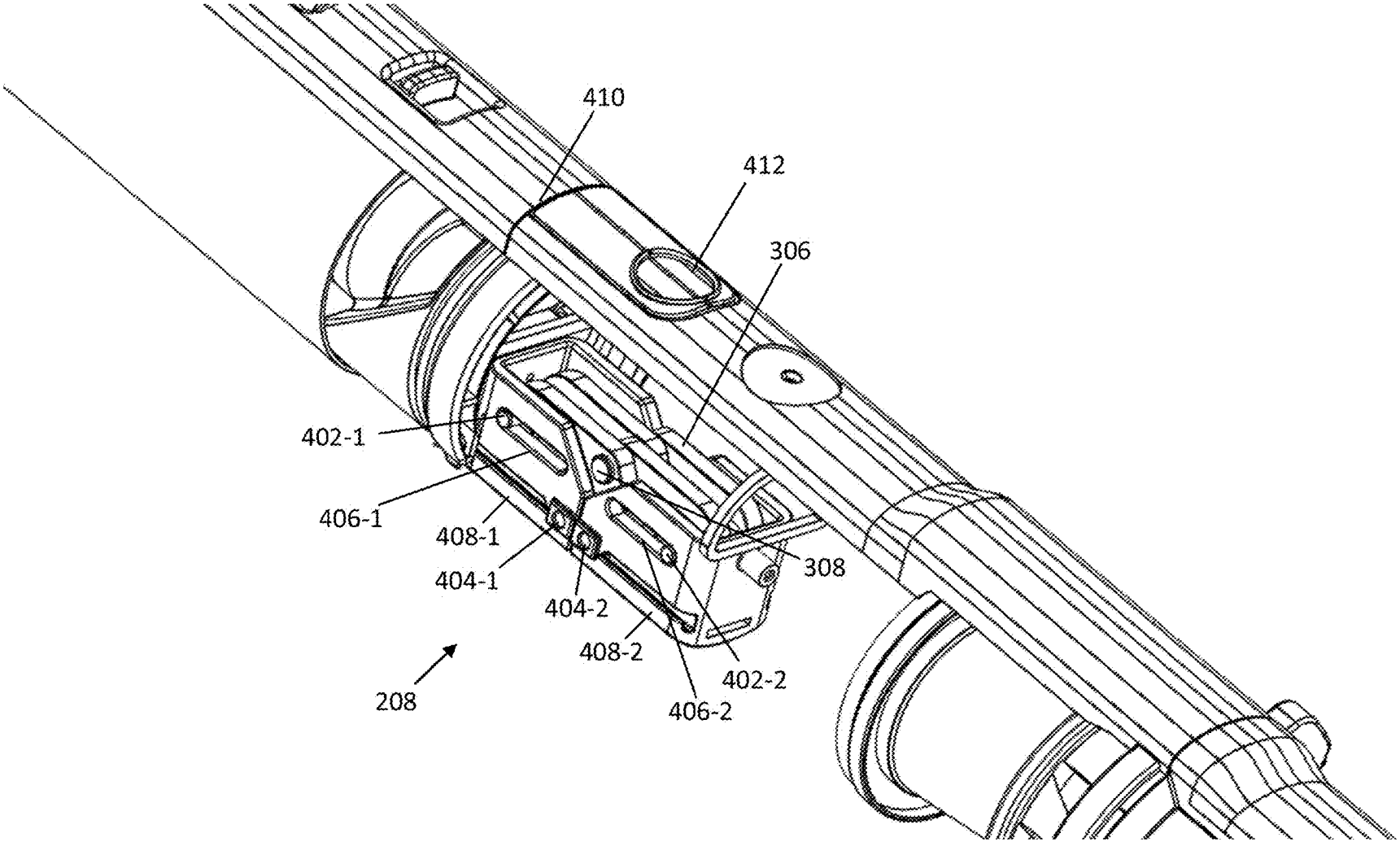
FIG. 4 illustrates a three-dimensional view of a hinge mechanism within a vacuum cleaner, in accordance with some embodiments of the present disclosure.

Hinge 208 includes a plurality of leaves 306 that rotate about one or more pins, such as a central pin 308. FIG. 4 illustrates hinge 208 while in its unfolded state and shows further details regarding the various structures that make up hinge 208. Each of leaves 306 may have a similar shape and be alternatingly offset from one another in a stacked configuration. A central pin 308 may pass through each of leaves 306, such that each of leaves 306 can rotate about central pin 308. According to some embodiments, a set of end pins 402-1 and 402-2 pass through alternating ones of leaves 306. For example, if four leaves 306 are stacked together, first end pin 402-1 passes through the first and third leaves 306 such that the first and third leaves can rotate about first end pin 402-1, while second end pin 402-2 passes through the second and fourth leaves 306 such that the second and fourth leaves 306 can rotate about second end pin 402-2. According to some embodiments, a set of interior pins 404-1 and 404-2 pass through alternating ones of leaves 306 that are different from the leaves passed through by the corresponding end pins 402-1 and 402-2. For example, first interior pin 404-1 passes through the second and fourth leaves 306 such that the second and fourth leaves can rotate about first interior pin 404-1, while second interior pin 404-2 passes through the first and third leaves 306 such that the first and third leaves 306 can rotate about second interior pin 404-2. In some embodiments, each of first end pin 402-1 and second end pin 402-2 are designed to laterally slide along corresponding tracks 406-1 and 406-2. Leaves 306 may be contained within housing structures 408-1 and 408-2 that are designed to separate from one another when hinge 208 is in a folded state.

According to some embodiments, a seam 410 may exist along the outer surface of body 101 between first section 104 and second section 106. Body 101 may separate along seam 410 during rotation about hinge 208. A mechanical catch may be used to maintain the longitudinal alignment between the first and second body sections when hinge 208 is in its unfolded state. This mechanical catch may be released using, for example, a pushbutton 412 on the outside of body 101, thus allowing for rotation of the different body sections about hinge 208.

Figure 5:
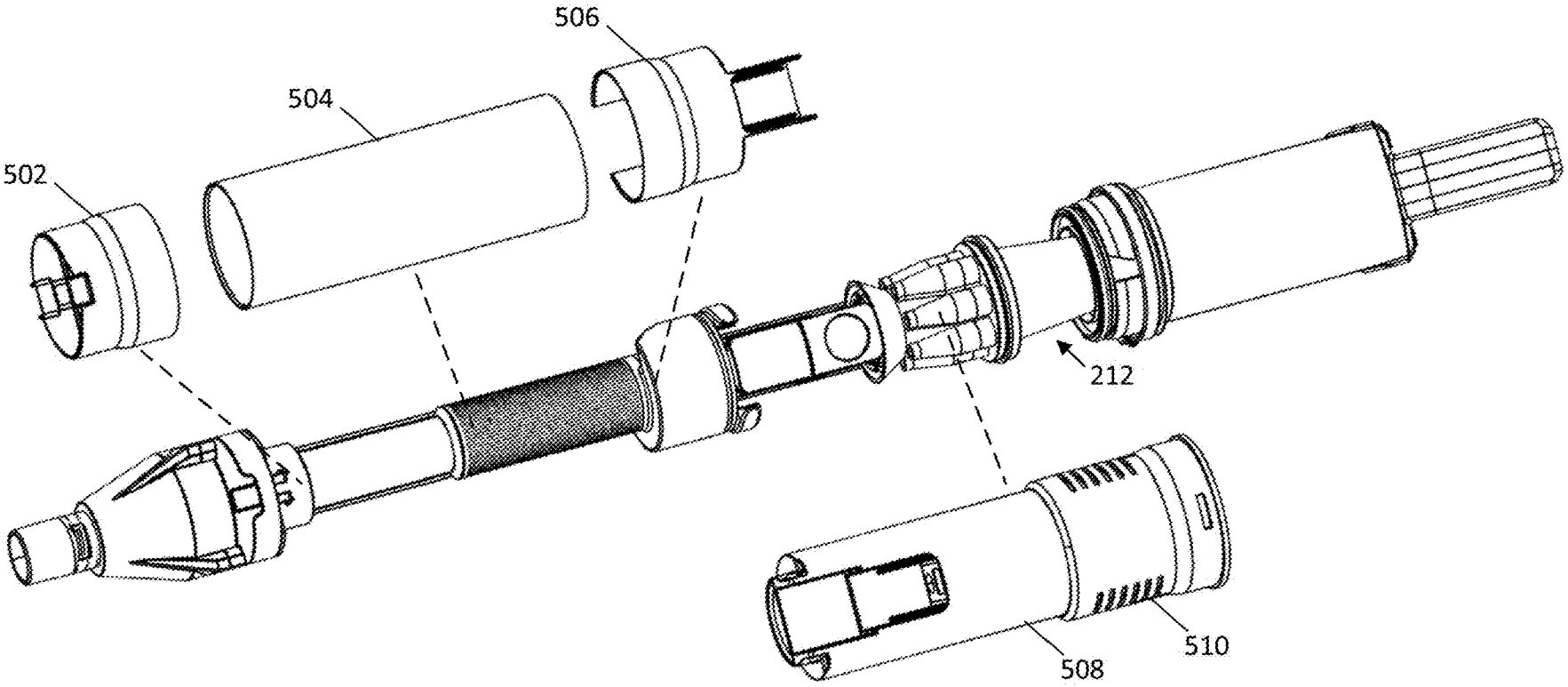
FIG. 5 illustrates a three-dimensional cut-away view of different sections of the vacuum cleaner, in accordance with some embodiments of the present disclosure.

FIG. 5 illustrates another view along the length of body 101 with various body segments removed. According to some embodiments, the first section of body 101 includes three different body segments, although any number of body segments can be used. For example, a lower body segment 502, a middle body segment 504, and an upper body segment 506 may connect together to form the exterior housing of the first body section 104. Each of lower body segment 502, middle body segment 504, and upper body segment 506 may be formed from injection-molded plastic or any sufficiently rigid plastic material. Middle body segment 504 may be a transparent plastic to allow for visual inspection of the first waste receptacle.

According to some embodiments, the second body section 106 includes a single housing structure 508 that protects the various components within second section 106. According to some embodiments, housing structure 508 also extends over at least a portion of third body section 108, such as over filter structure 212. The portion of housing 508 that fits around filter structure 212 may include any number of vents 510 to allow for air that has passed through the post filter on filter structure 212 to escape through vents 510 and away from the vacuum cleaner. Housing 508 may be formed from injection-molded plastic or any sufficiently rigid plastic material.

Figure 6A:
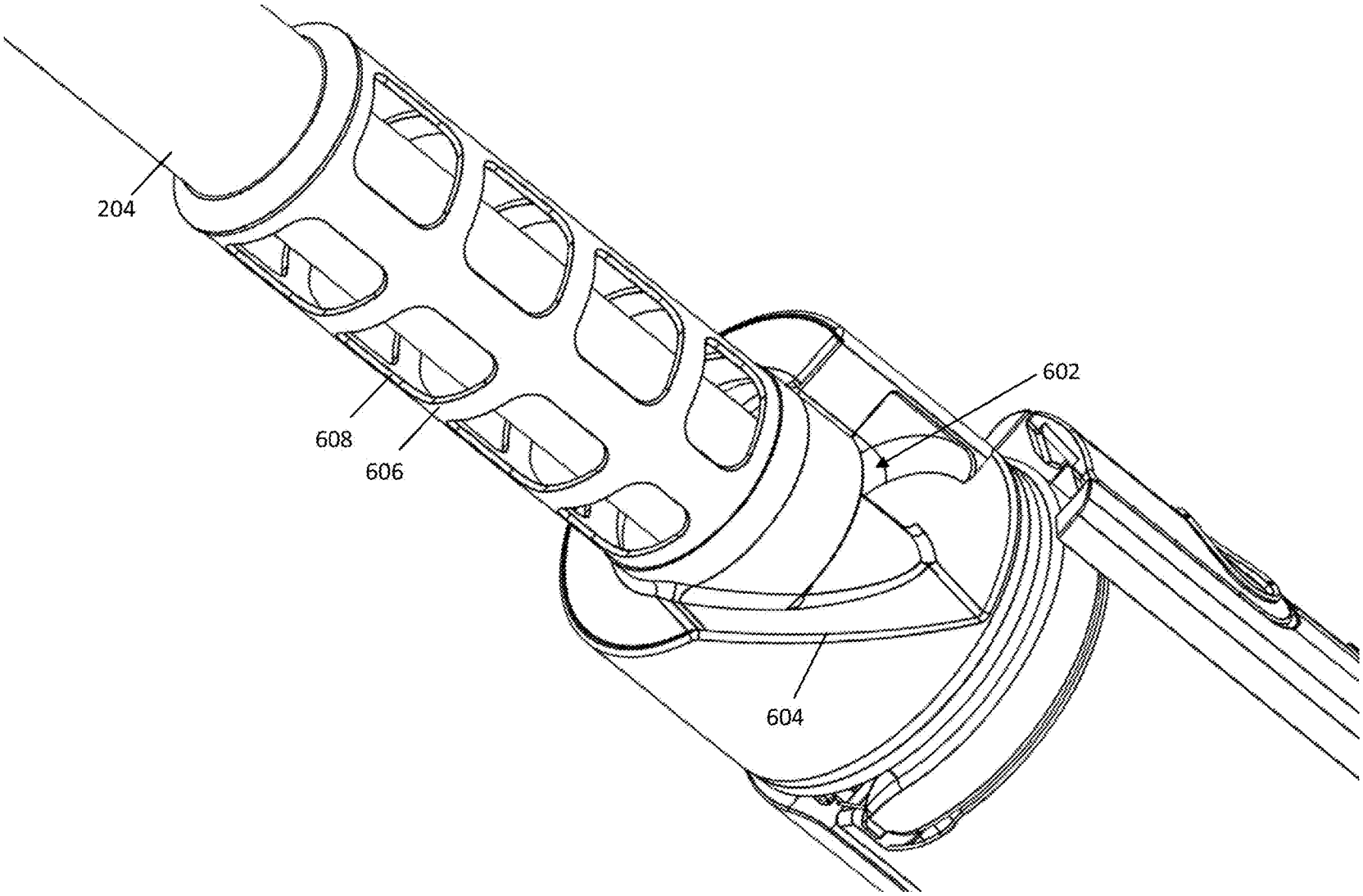
FIGS. 6A-6C illustrate three-dimensional views of different waste receptacle designs, in accordance with some embodiments of the present disclosure.

FIG. 6A provides a closer view of the inside of the first waste receptacle, according to an embodiment. As discussed above, first air suction tube 204 extends axially through a middle of the first waste receptacle. Air is drawn upwards through first air suction tube 204 where it eventually escapes out from opening 602 into the first waste receptacle. According to some embodiments, a ramp structure 604 may be provided adjacent to opening 602 to help direct the air downwards into the first waste receptacle.

The mesh or screen 206 has been removed in this view to show the underlying second air suction tube 606 wrapping around a portion of first air suction tube 204. Second air suction tube 606 includes a plurality of windows 608 (e.g., openings) that allow air to pass through them where it is sucked upwards and into the second body section. Any number of windows 608 may be used and they may be any size and/or shape. Mesh or screen 206 (removed in this view) may wrap around each of windows 608 such that only the air along with particles small enough to pass through the filter enter through windows 608 and into second air suction tube 606.

Figure 6B:
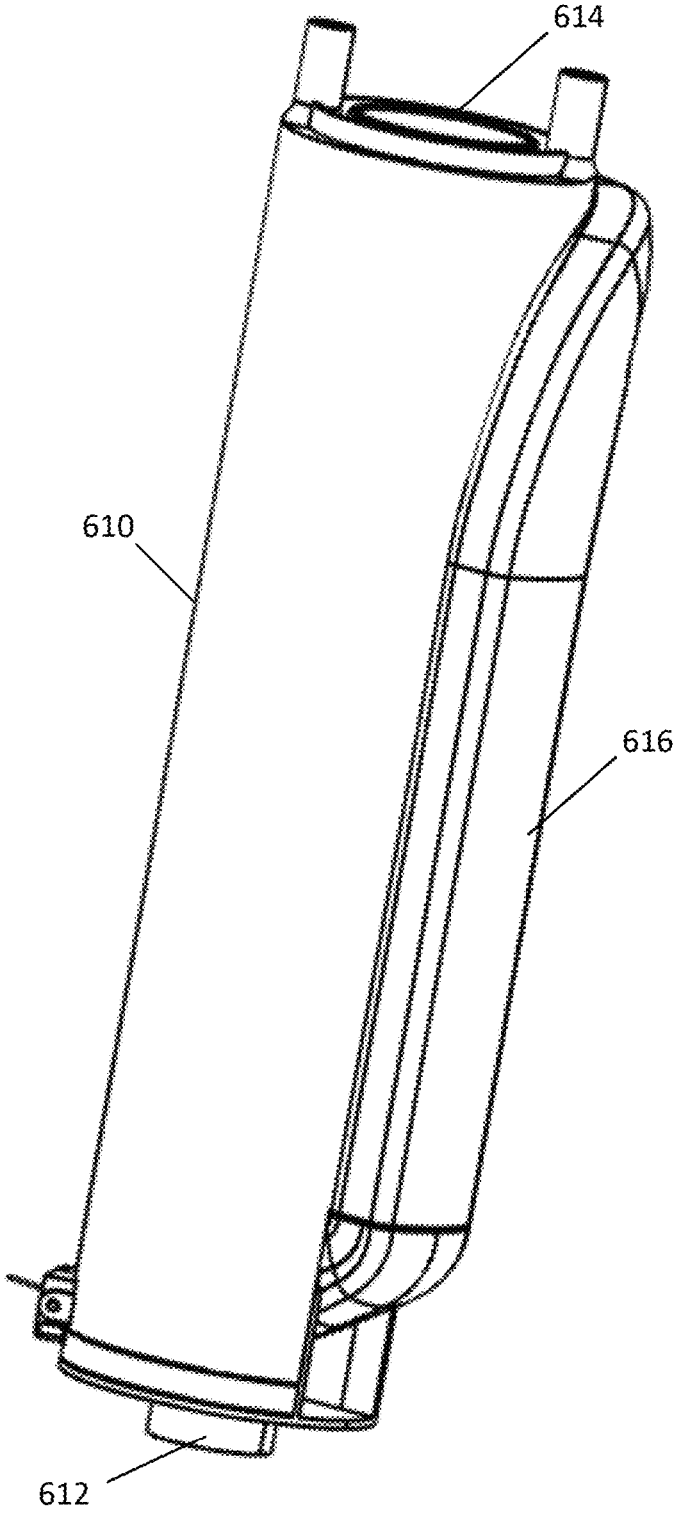

As discussed above, the first air suction tube may also extend along an outside of the first waste receptacle rather than through a center of it. FIG. 6B illustrates another view of a housing structure around the first waste receptacle, according to another embodiment. In this case, a housing 610 includes a distal end 612 that fluidically interfaces with, for example, air suction inlet 218 at the distal end of body 101. Housing 610 also includes a proximal end 614 that includes an opening to fluidically interface with any air suction tube structure within second body section 106. According to some embodiments, air suction tube 616 is fluidically connected with the opening at distal end 612 and is drawn outside of housing 610 such that it does not extend through the first waste receptacle. Air suction tube 616 may extend up a length of housing 610 and wrap back into a top portion of housing 610 to expel the air into the top of the first waste receptacle.

Figure 6C:
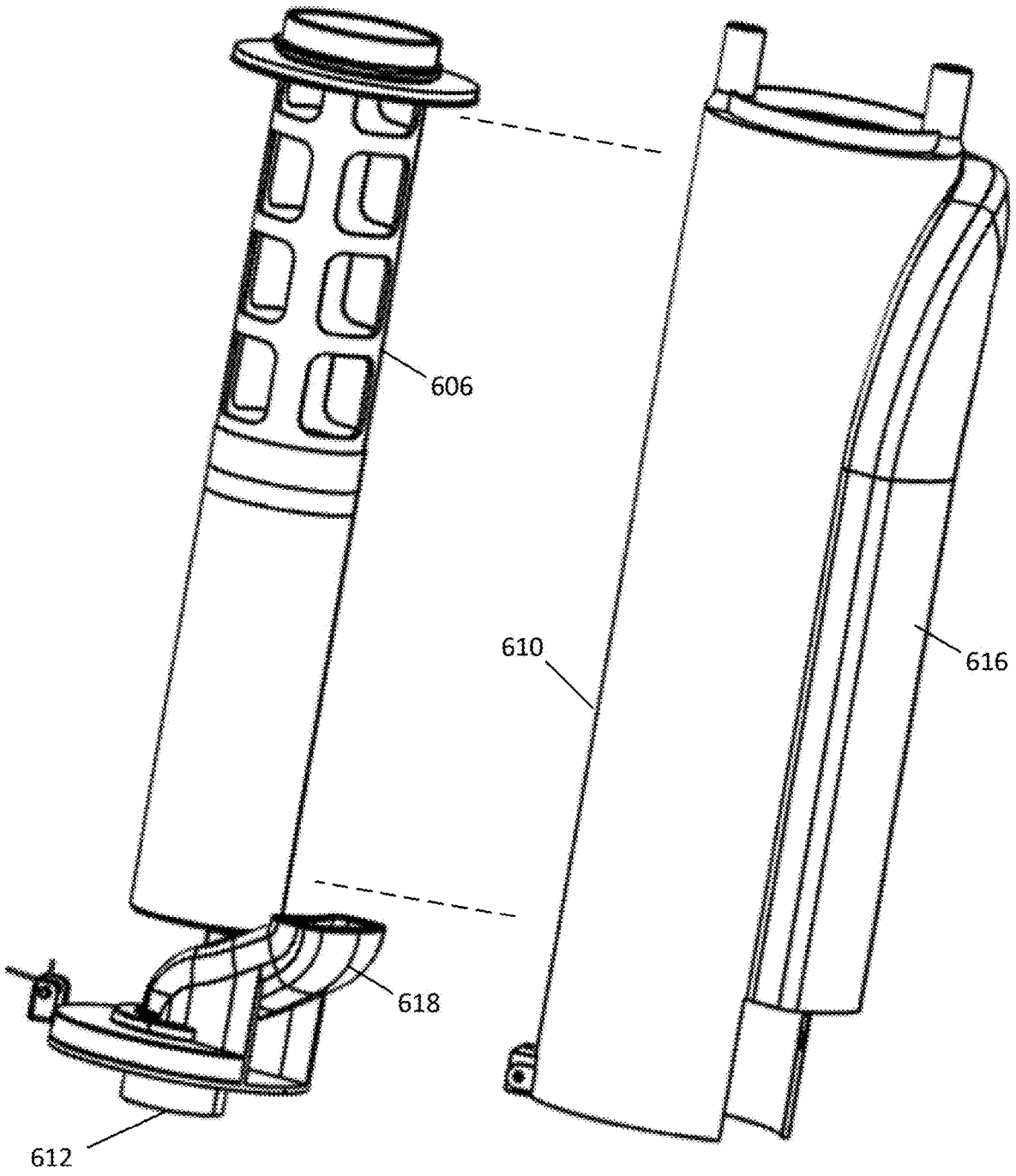

FIG. 6C illustrates another view of housing 610 pulled away from the first waste receptacle. Inside of housing 610, second air suction tube 606 (illustrated here again without the filter) may still be used to bring the air within the first waste receptacle up into the second body section 106. According to some embodiments, housing 610 may be a single machined piece that includes a portion of air suction tube 616 that connects to a lower air passageway 618. Air passageway 618 may be a curved passageway that directs air from the opening at distal end 612 up into air suction tube 616. It should be noted that this design allows for second air suction tube 606 to have a larger interior volume as compared to the design illustrated in FIG. 6A because it does not have the smaller first air suction tube 204 extending upwards through it.

Figure 7:
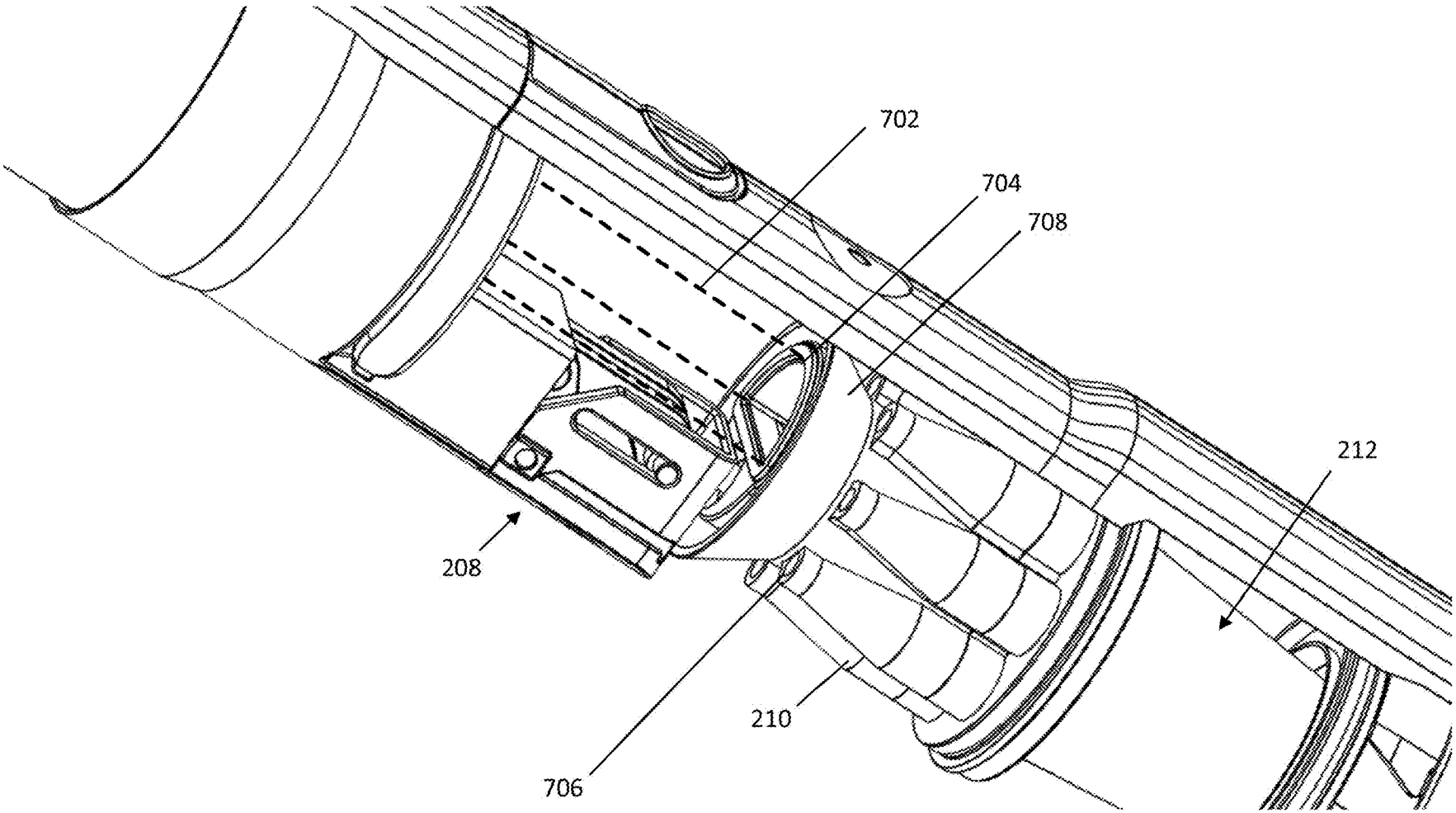
FIG. 7 illustrates a three-dimensional view of a second waste receptacle, in accordance with some embodiments of the present disclosure.

FIG. 7 illustrates a closer view of the second body section 106, according to some embodiments. Hinge 208 may be located at least partially or fully within second body section 106. As discussed above, air is passed from first body section 104 into a second air suction passageway 304 and across a bridge 702 (shown here with dashed lines) that acts as a fluidic connector between second air suction passageway 304 at a distal end of second body section 106 and an opening 704 leading into cyclonic separators 210. According to some embodiments, the air that is sucked into cyclonic separators 210 is spiraled around the nozzle-like cyclonic structures allowing dust and other fine debris to fall out through nozzle openings 706. The debris may impact a flared skirt 708 after it has been ejected from nozzle openings 706. Skirt 708 may be provided to help spread the debris outwards into the surrounding second waste receptacle. According to some embodiments, the second waste receptacle includes the open volume around skirt 708 and also the volume around the outside of bridge 702. A cover may be provided over hinge 208 (such as shown over the left portion of hinge 208) to prevent debris from settling within hinge 208. According to some embodiments, bridge 702 and the outside housing walls of the second body section 106 may be formed from a single plastic piece.

As discussed above, some designs of the vacuum cleaner omit the second waste receptacle and thus both it and the cyclonic separators 210 are not present. In such embodiments, air may be passed via bridge structure 702 directly to filter structure 212.

Figure 8A:
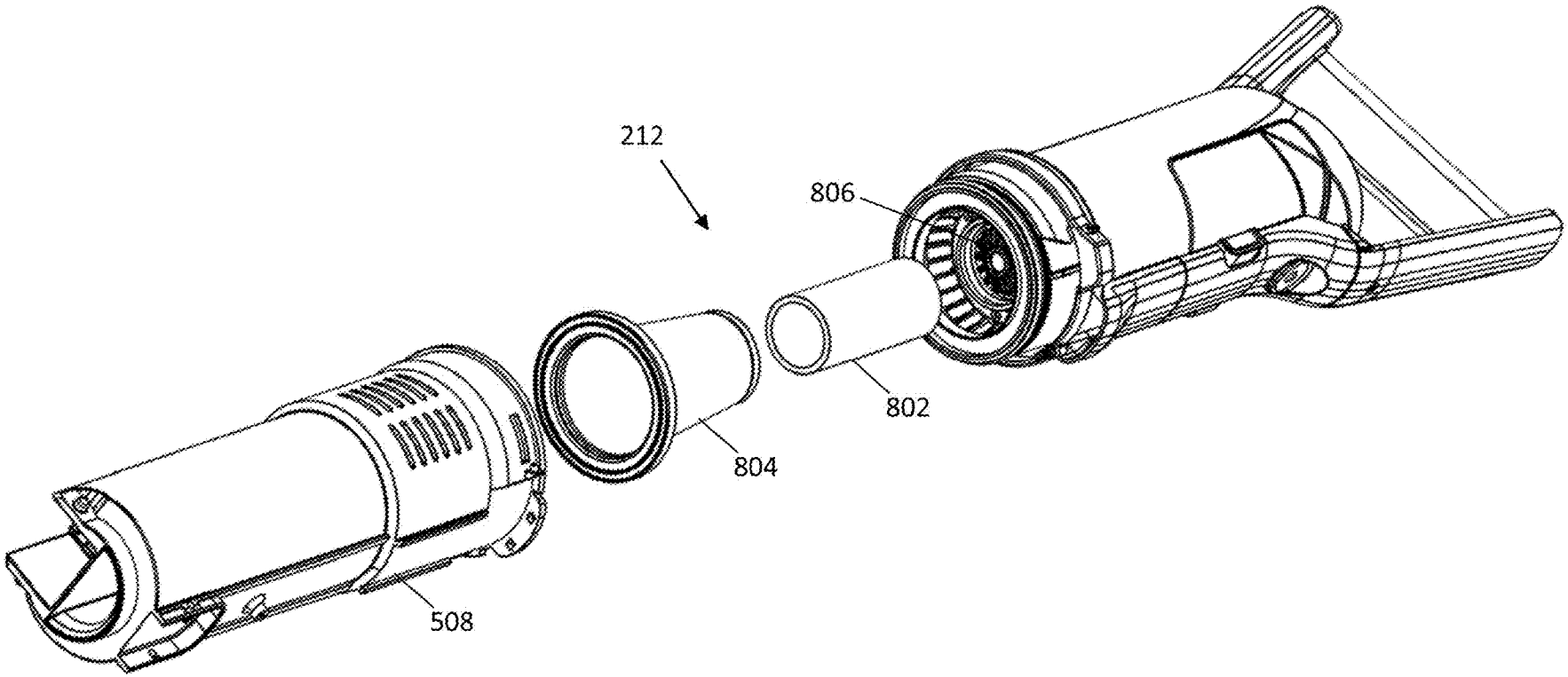
FIGS. 8A and 8B illustrate different views of a filter structure within the vacuum cleaner, in accordance with some embodiments of the present disclosure.

FIG. 8A illustrates an exploded view of filter structure 212 arranged adjacent to a motor inlet 806, according to some embodiments. Housing structure 508 has been pulled away from the top portion of the vacuum cleaner to provide access to filter structure 212. According to some embodiments, filter structure 212 includes both a pre-filter 802 and a post-filter 804. Each of pre-filter 802 and post-filter 804 may be cylindrical. Post-filter 804 may have a slightly tapered cylindrical shape with a wider opening at its distal end compared to its proximal end.

According to some embodiments, pre-filter 802 is arranged concentrically within post filter 804. As illustrated more clearly in FIG. 8B, pre-filter 802 may have a diameter smaller than the diameter of post-filter 804, such that both filters can be concentrically aligned with the central longitudinal axis of body 101. In some examples, pre-filter 802 has a diameter between about 1" and about 2" or between about 0.5" and about 1.5". Post-filter 804 may have a diameter at its distal opening between about 2" and about 3" or between about 2.5" and about 3.5". As noted above, the diameter of the proximal opening of post-filter 804 may be slightly smaller, such as around 0.5" less than the diameter of the distal opening of post-filter 804. Pre-filter 802 may include any known filter material designed to trap most particles from entering the motor. Examples of pre-filter material include activated carbon in powered, granular, or honeycomb form, or foam-based materials. Post-filter 804 may be a high efficiency particulate air (HEPA) filter. Pre-filter 802 and post-filter 804 may be coupled together such that the entire filter arrangement can be removed in one piece. In some other embodiments, post-filter 804 may be removed separately from pre-filter 802.

According to some embodiments, air is brought up first through pre-filter 802, passes through the motor, and then is expelled from the motor through post-filter 804. This pathway is illustrated in FIG. 8C, which illustrates a cross-section taken through filter structure 212 and motor 214. According to some embodiments, air is drawn from cyclonic separators 210 (if present) and passes through pre-filter 802 into an air suction passageway within an inner diameter of pre-filter 802. The air may first be drawn into the region between pre-filter 802 and post-filter 804 before being drawn through the wall of pre-filter 802 and into the air suction passageway. The air may then be drawn through the air suction passageway defined by the inner diameter of pre-filter 802 towards motor 214 where it enters through motor inlet 806.

According to some embodiments, motor 214 expels the air out from the back or sides of the motor where the air is then blown back towards filter structure 212 via one or more conduits 808. In some embodiments, conduits 808 run along an inner surface of body 101. Any number of conduits 808 may be used. In some examples, a single annular conduit 808 around the inner circumference of the body is used to direct the air back towards filter structure 212, and more specifically towards post-filter 804. The air is then blown through post-filter 804 before it is vented outwards through vents 510. By redirecting the airpath back towards the distal end of the vacuum cleaner after it has passed through the motor, the noise of the motor and blowing air perceived by the user is decreased.

Figure 8B:
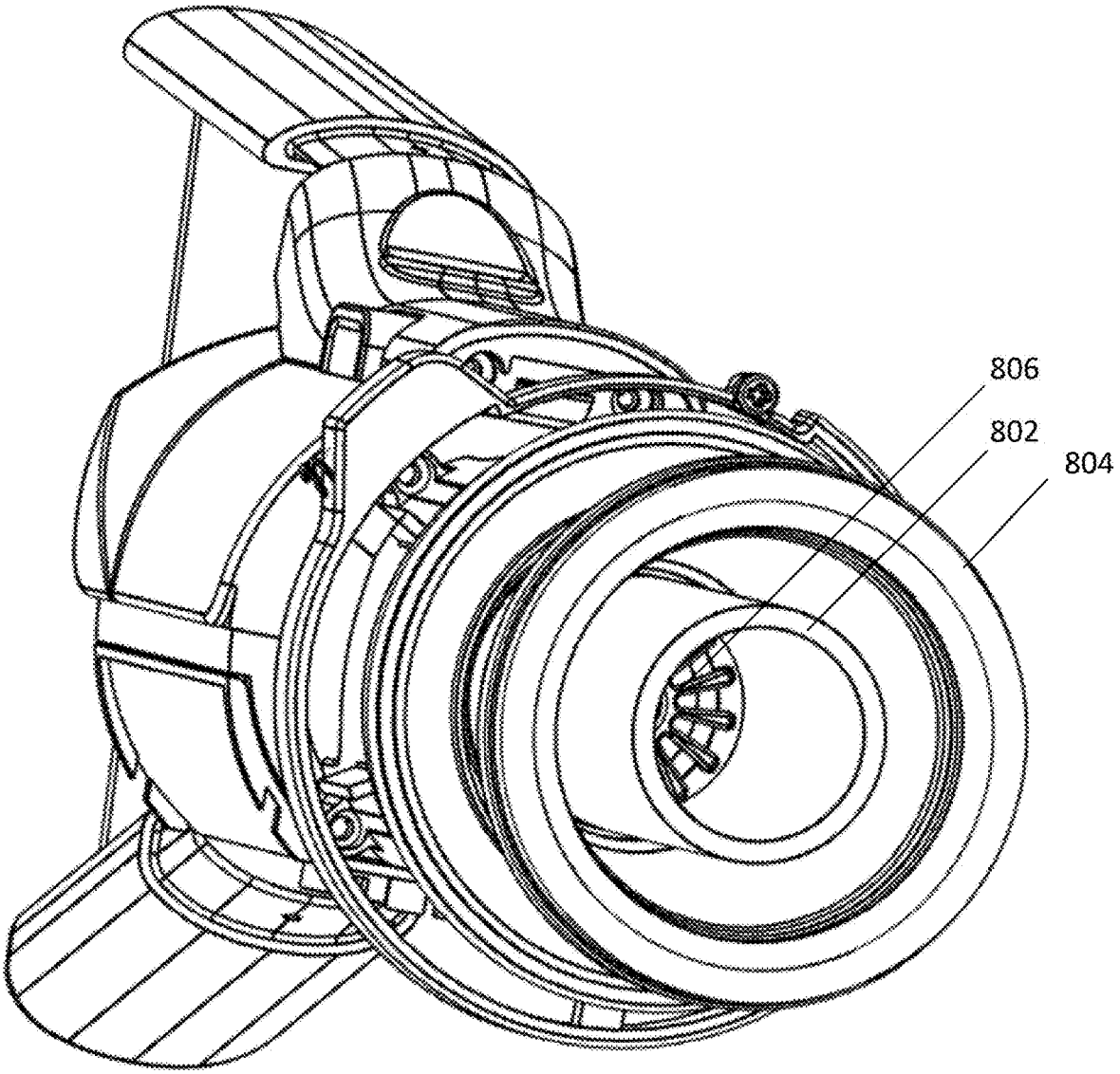
Figure 8C:
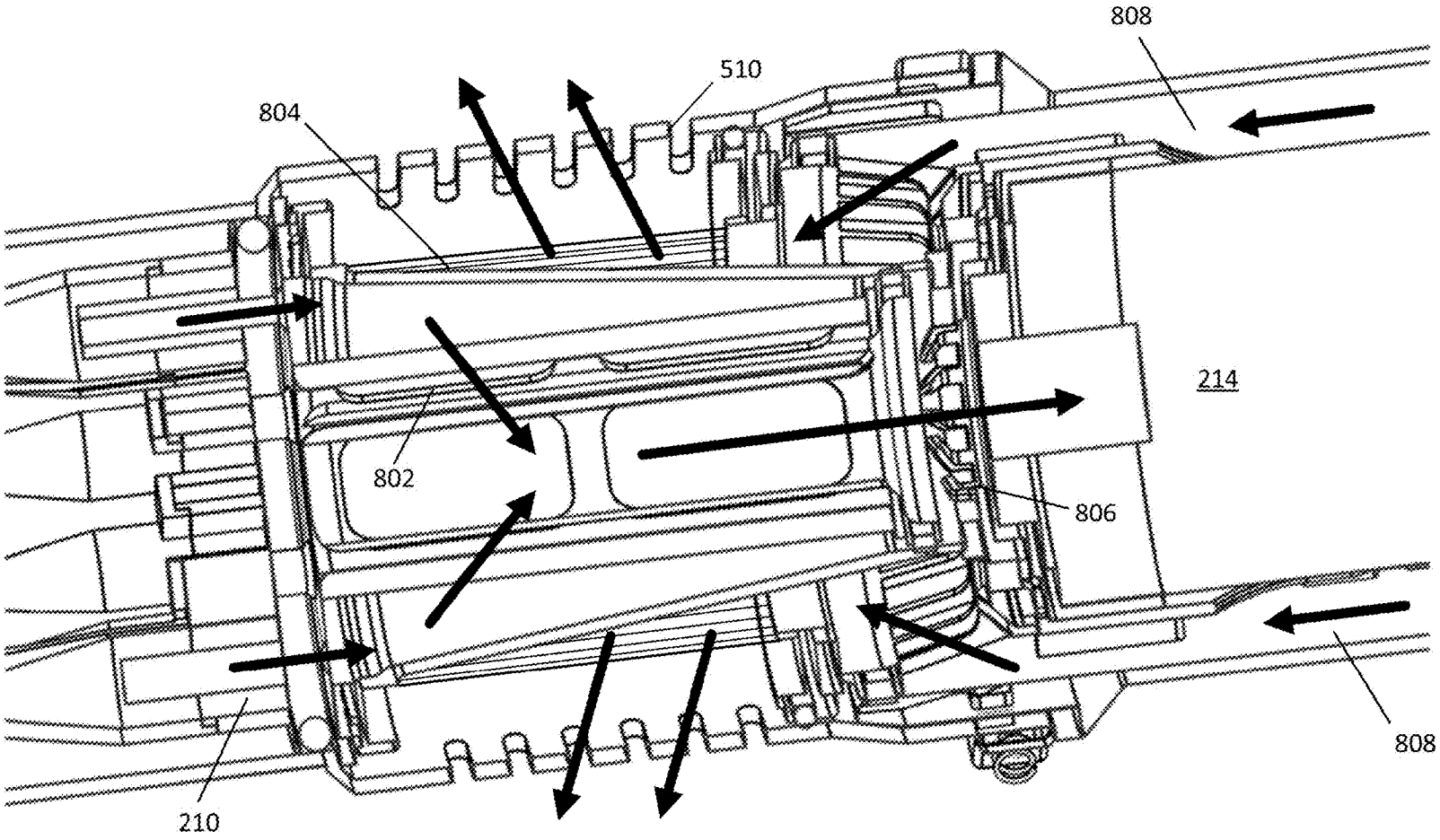
FIG. 8C illustrates a cross-section view of airflow through the filter structure and a motor, in accordance with some embodiments of the present disclosure.
Figure 8D:
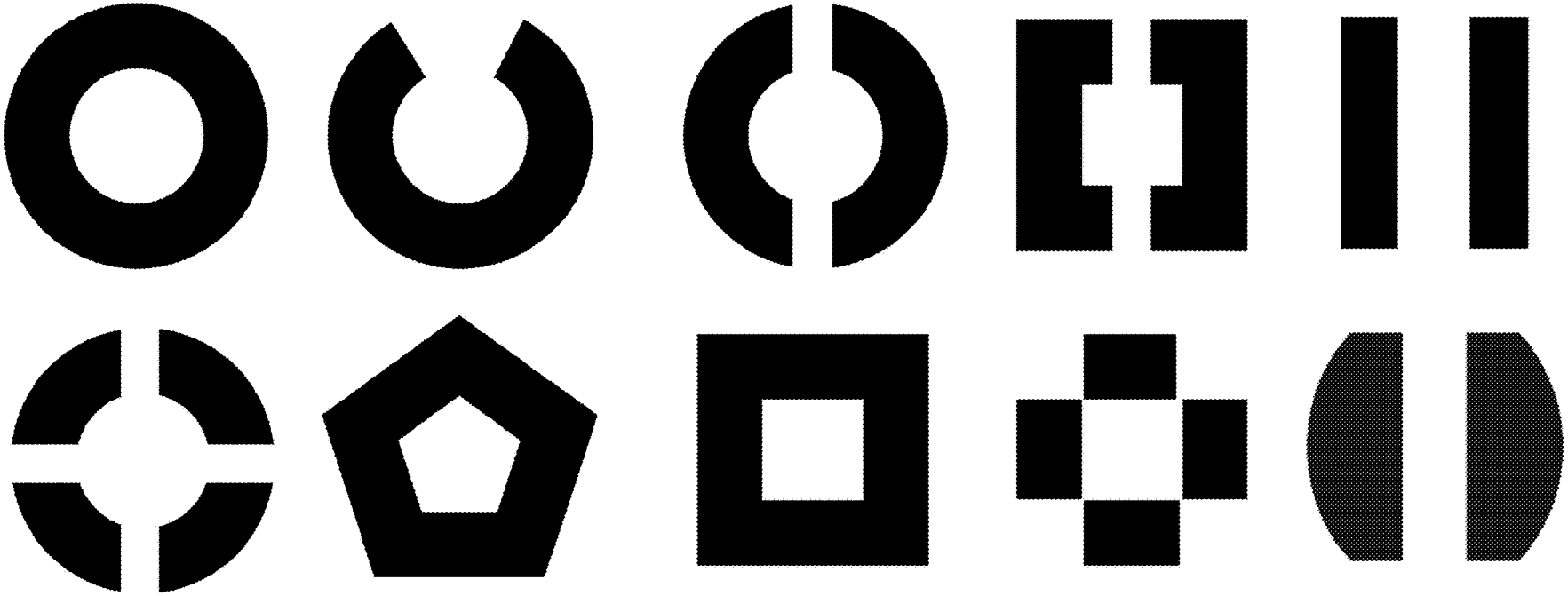
FIG. 8D illustrates cross-sections of possible shapes for the filters within the vacuum cleaner, in accordance with some embodiments of the present disclosure.

Although a cylindrical pre-filter 802 and a cylindrical post-filter 804 are illustrated in FIGS. 8A-8C, it should be understood that other filter shapes are able to be used as well to achieve a similar result. Accordingly, pre-filter 802 may be nested within post-filter 804 in embodiments where only one of pre-filter 802 or post-filter 804 has a circular cross-section or in embodiments where neither pre-filter 802 or post-filter 804 has a circular cross-section. FIG. 8D illustrates a series of possible cross-sectional shapes for either or both of pre-filter 802 and post-filter 804, according to some embodiments. Some filter designs have a circular cross-section with one or more missing segments, such as one missing segment, two missing segments, or four missing segments. Some filter designs have cross-sections with straight, parallel segments, or are shaped like brackets or crescents that face one another. Still other filter designs may have a cross-section of basic shapes other than a circle, such as a square or pentagon, to name a few examples. In some embodiments, a given filter designed with a cross-sectional basic shape may be missing one or more segments. Regardless of the cross-sectional shape of either pre-filter 802 or post-filter 804, pre-filter 802 can have a smaller overall cross-sectional shape such that it can fit within the cross-sectional shape of post-filter 804, according to some embodiments.

Figure 9:
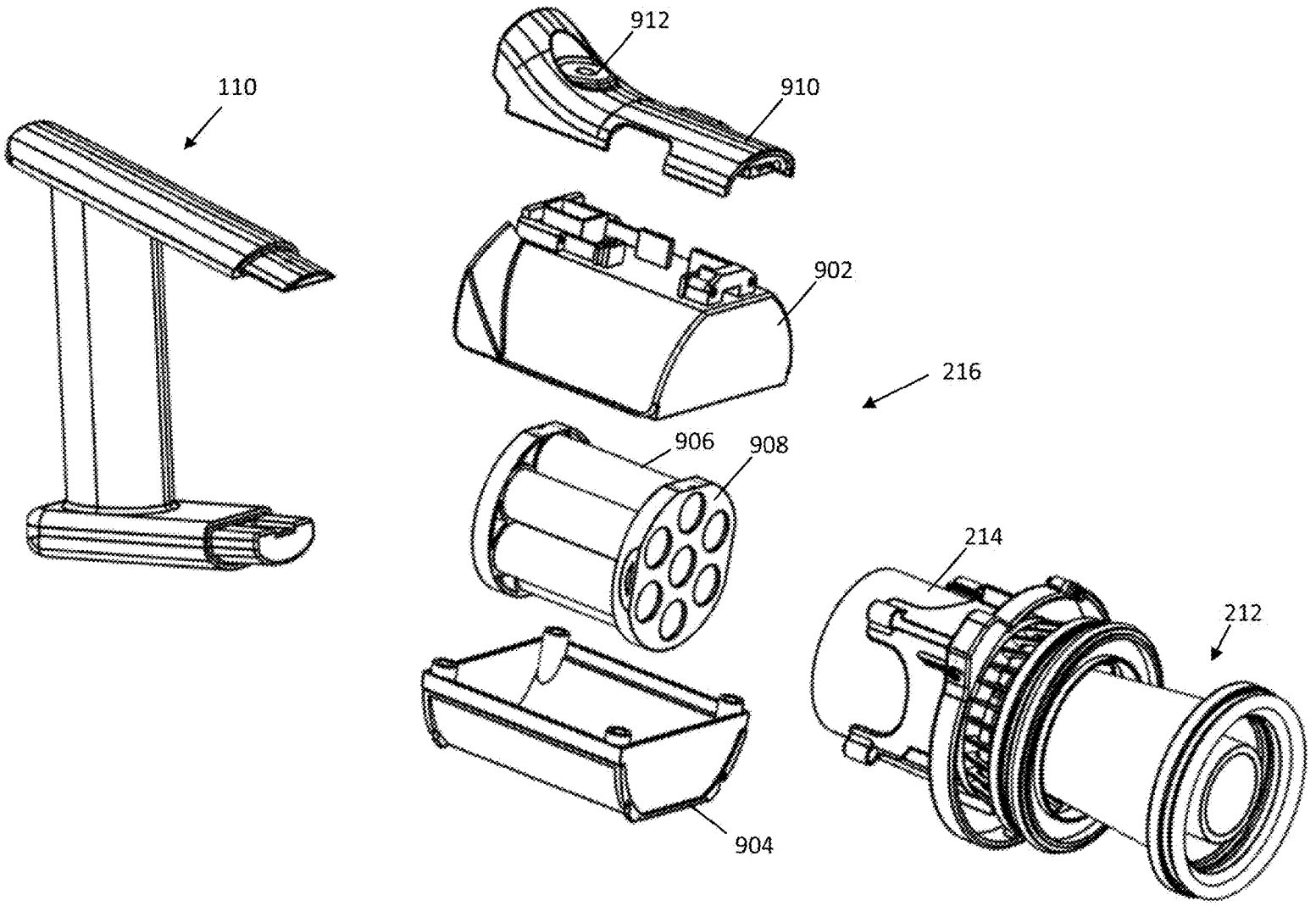
FIG. 9 illustrates an exploded view of a proximal end of the vacuum cleaner having energy storage devices, in accordance with some embodiments of the present disclosure.

FIG. 9 illustrates an exploded view of the battery pack 216 at the proximal end of the vacuum cleaner, according to some embodiments. Battery pack 216 may be arranged behind motor 214, such that it is between motor 214 and handle 110. Battery pack 216 includes a housing structure to protect the energy storage devices that may be separated into a first housing structure 902 and a second housing structure 904. First and second housing structures 902/904 may be used to define and encompass an inner volume where one or more energy storage devices 906 are arranged. In some embodiments, energy storage devices 906 are held in place by one or more end brackets 908.

Energy storage devices 906 may be any replaceable batteries, such as AA, AAA, C, or D batteries. In some embodiments, energy storage devices 906 represent one or more rechargeable batteries that may be charged via an external port on an outside surface of body 101. Wireless charging options may also be used.

In some embodiments, a top cover 910 may be arranged over battery pack 216, such that top cover 910 is a part of body 101. In some examples, top cover 910 couples to a part of handle 110. A power button 912 may be provided on a surface of top cover 910. Power button 912 may be pressed to activate motor 214 and begin the suction of air. Other activation mechanisms may also be used, such as a switch or lever.

Figure 10:
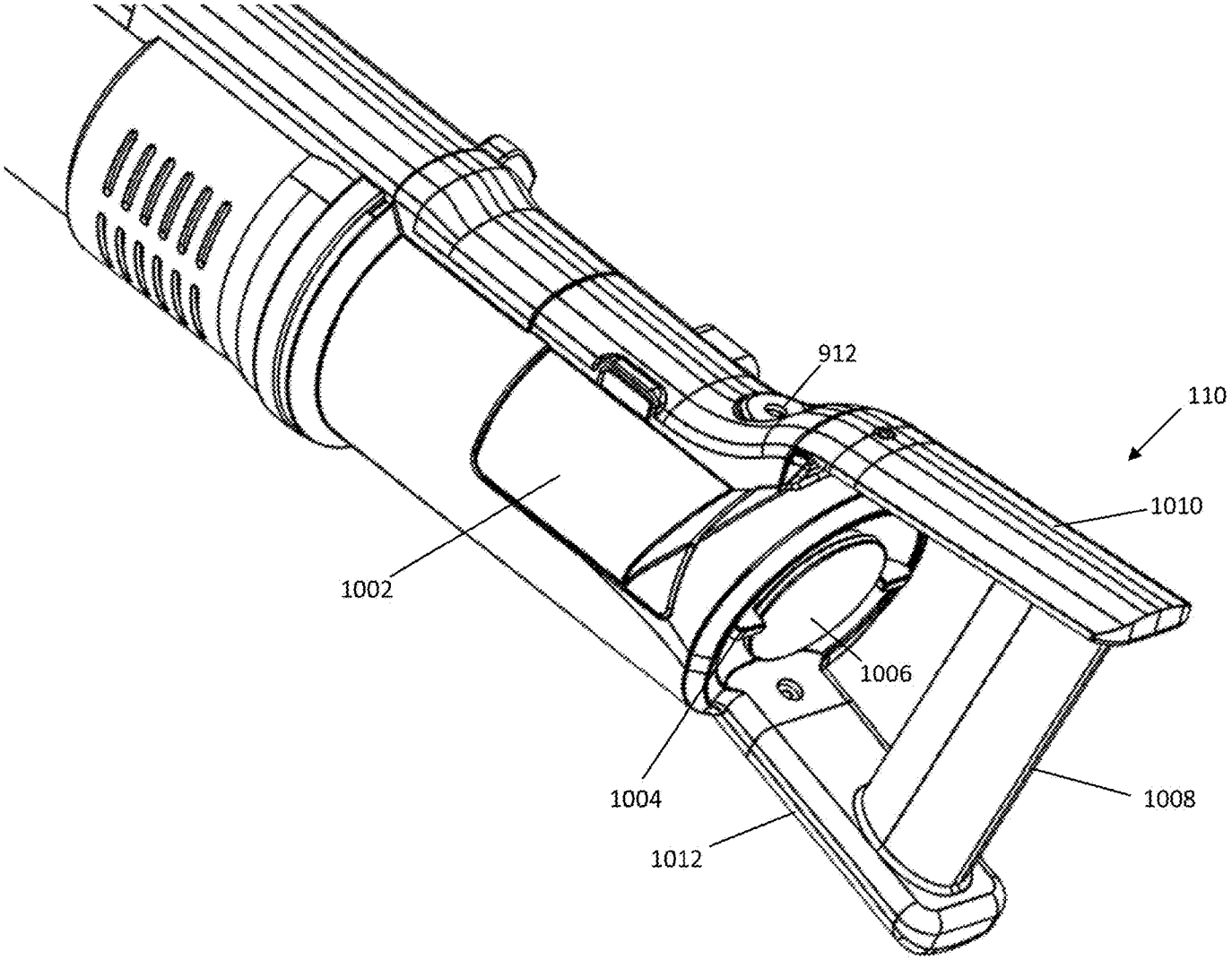
FIG. 10 illustrates a three-dimensional view of a handle coupled to a proximal end of the vacuum cleaner, in accordance with some embodiments of the present disclosure.

FIG. 10 illustrates a close-up view of a proximal end of the vacuum cleaner where handle 110 couples to the proximal end of body 101. A battery compartment door 1002 may be present on a side of body 101. Battery compartment door 1002 can be removed to provide access to energy storage devices 906. In some embodiments, a power control lever 1004 may be present on a proximal end plate of body 101. Power control lever 1004 may be moved radially around an inner disk 1006 to change the current provided to motor 214 from energy storage devices 906. Any power control circuitry using a potentiometer or other similar type of adjustable circuit element may be used to adjust the power level using power control lever 1004.

According to some embodiments, handle 110 provides a pistol-grip design that aligns body 101 of the vacuum cleaner as if it were an extension of the user's arm. Handle 110 includes a grip 1008 that the user curls his or her hand around to grip the vacuum cleaner. Grip 1008 extends between a first bracket 1010 and a second bracket 1012. Each of first and second bracket 1010/1012 may be substantially identical in size and shape, and each extending parallel to the longitudinal central axis of body 101 and away from the proximal end of body 101. Each of brackets 1010 and 1012 can be essentially aligned with opposite sides of body 101. For example, the brackets may be within 2 inch, within 1 inch, or within 0.5 inch of a circle defined by the outside of third section 108. In some embodiments, grip 1008 is positioned behind the distal end of body 101, such that grip 1008 intersects longitudinal central axis 112 of body 101.

Figure 11A:
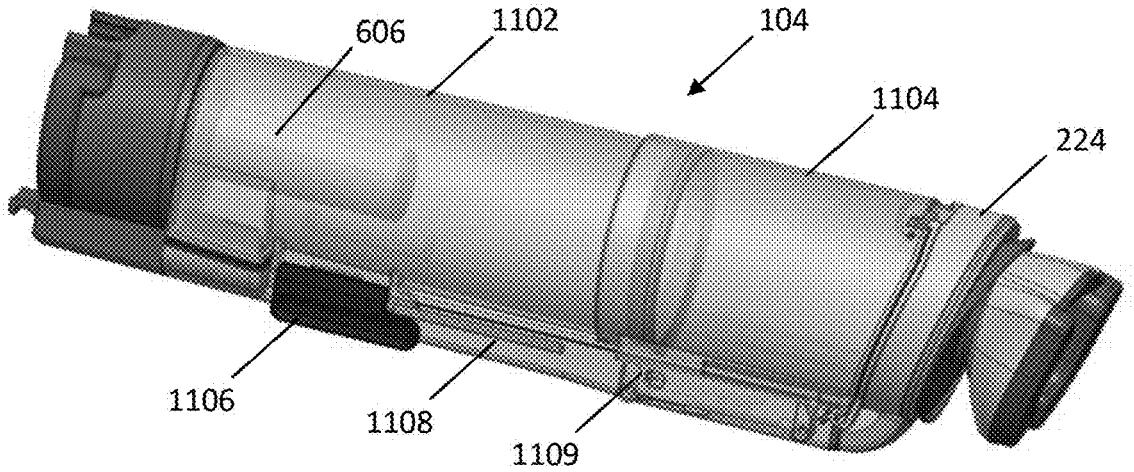
FIGS. 11A-11C illustrate an operation performed to empty the contents of the waste receptacle at the distal end of the vacuum cleaner, in accordance with some embodiments of the present disclosure.
Figure 11B:
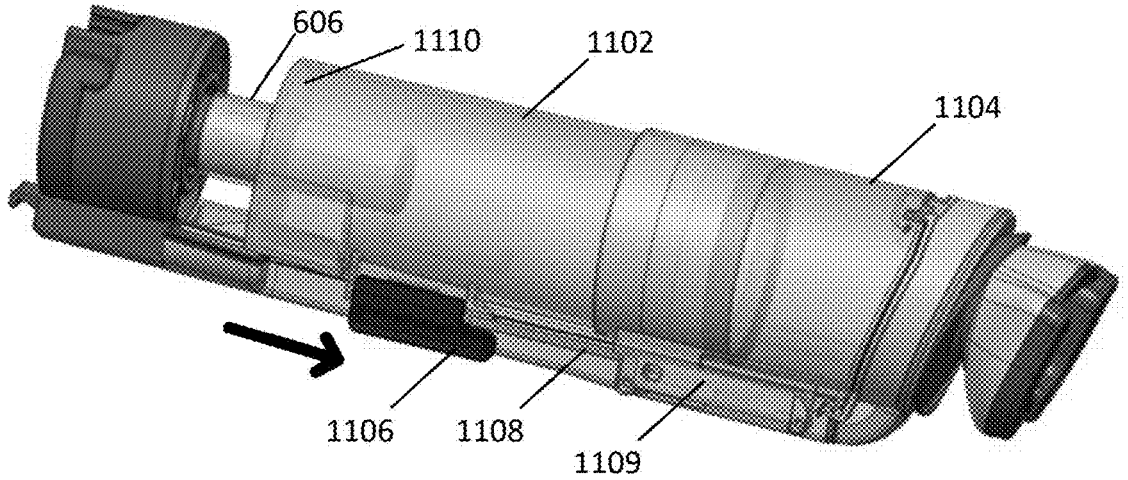
Figure 11C:
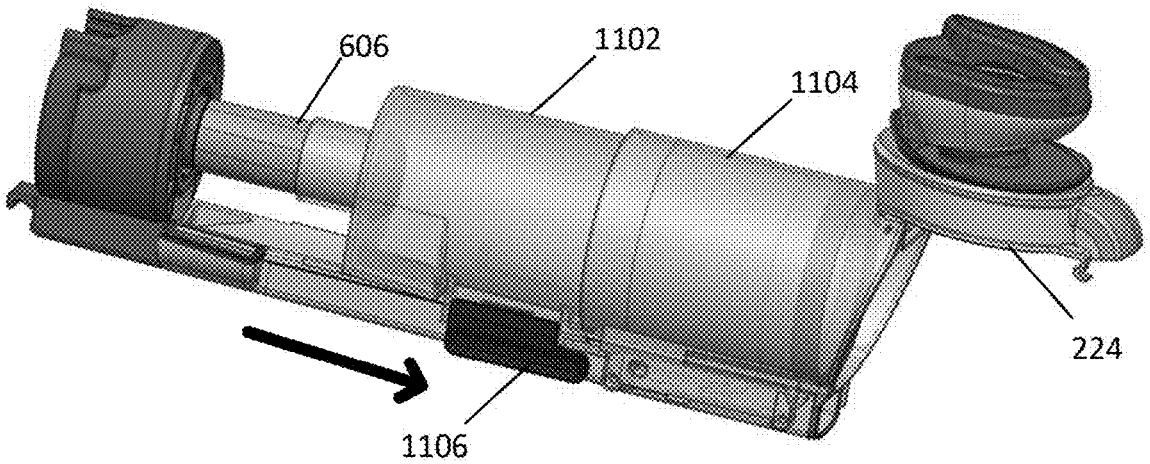

FIGS. 11A-11C illustrate first section 104 of body 101 where the first waste receptacle is located along with a mechanism for emptying the contents of the first waste receptacle, according to some embodiments. As seen in FIG. 11A, the first waste receptacle may be defined by a first housing section 1102 and a second housing section 1104. First housing section 1102 may have a slightly smaller diameter compared to second housing section 1104, such that second housing section 1104 slides over one end of first housing section 1102. In some embodiments, the inner diameter of first housing section 1102 can be equal to, or less than, the outer diameter of second housing section 1104. There may be enough clearance between the two housing sections to allow telescoping of the two sections. As will be discussed herein, according to some embodiments, second housing section 1104 remains fixed while first housing section 1102 is designed to axially translate along the inner walls of second housing section 1104.

A slider grip 1106 may be coupled to a track 1108 along one side of first housing section 1102, according to some embodiments. Track 1108 may be a part of a backbone 1109 that runs along the length of both first housing section 1102 and second housing section 1104. In some embodiments, backbone 1109 is fixedly attached to second housing section 1104, with backbone 1109 being a part of vacuum body 101. Backbone 1109 may also include an air conduit to direct air drawn from the distal end of the vacuum cleaner into the first waste receptacle, such as into an inlet at the top portion of first housing section 1102.

Slider grip 1106 may be designed to translate along track 1108 after being pinched or pressed by a user's finger or fingers. Accordingly, slider grip 1106 may be able to move after being pinched with two or more fingers (e.g., squeezed inwards) or after being pressed on using one or more fingers, to name a few examples.

As illustrated in FIG. 11B, the movement of slider grip 1106 along track 1108 causes a corresponding movement of first housing section 1102. According to some embodiments, first housing section 1102 moves towards the distal end of first body section 104 by sliding within second housing section 1104. In some embodiments, a back wall 1110 of first housing section 1102 slides down the outside of second air suction tube 606, thus aiding in the removal of any debris clinging to the outside surface of second air suction tube 606. Additionally, a portion of second air suction tube 606 becomes exposed outside of first body section 104 as it slides away.

As illustrated in FIG. 11C, slider grip 1106 has reached the end of track 1108 and/or back wall 1110 of first housing section 1102 has reached the end of air suction tube 606. In either case, a full length of second housing section 1104 may include a portion of first housing section 1102 within itself. At this point, waste receptacle door 224 may be opened to release any contents within the first waste receptacle. In some examples, waste receptacle door 224 is manually opened by pulling the door open. In some examples, waste receptacle door 224 is triggered to be opened automatically either by the movement of slider grip 1106 into a final distal position or by movement of first housing section 1102 sliding across a distal portion of second housing section 1104. In some embodiments, a mechanical catch or lever at either position is depressed or otherwise actuated to release waste receptacle door 224.

It should be understood that slidable waste receptacle design illustrated, for example, in FIGS. 11A-11C can be utilized within any type of vacuum cleaner to empty the waste receptacle. For example, the slidable waste receptacle design can be used within any standard upright vacuum cleaner, any stick vacuum cleaner, or any canister vacuum cleaner.

Figure 12A:
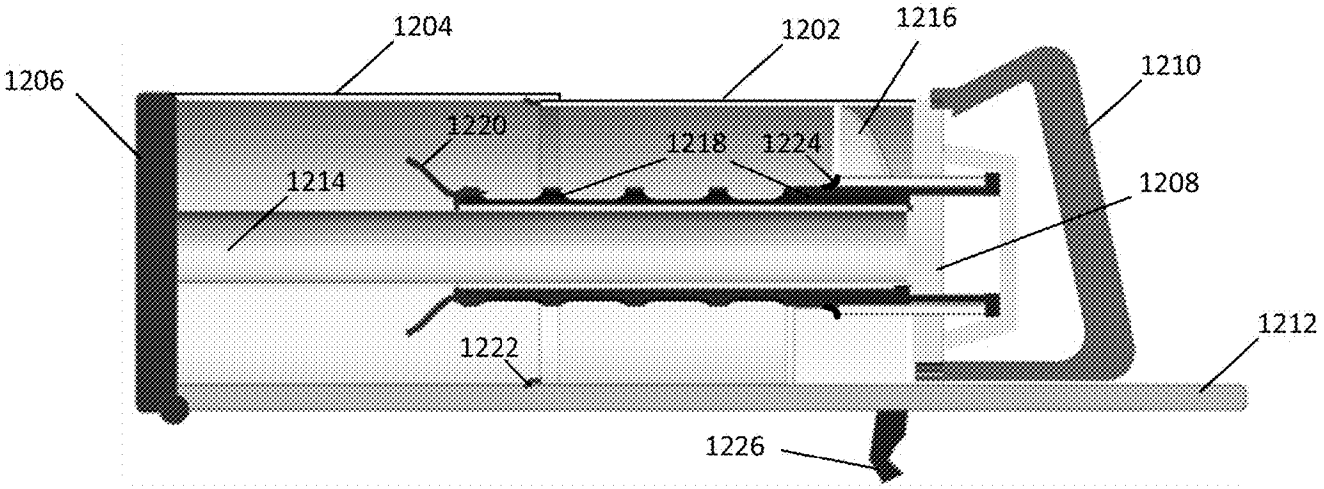
FIGS. 12A and 12B illustrate an operation performed to empty contents of another waste receptacle used within a vacuum cleaner, in accordance with some embodiments of the present disclosure.
Figure 12B:
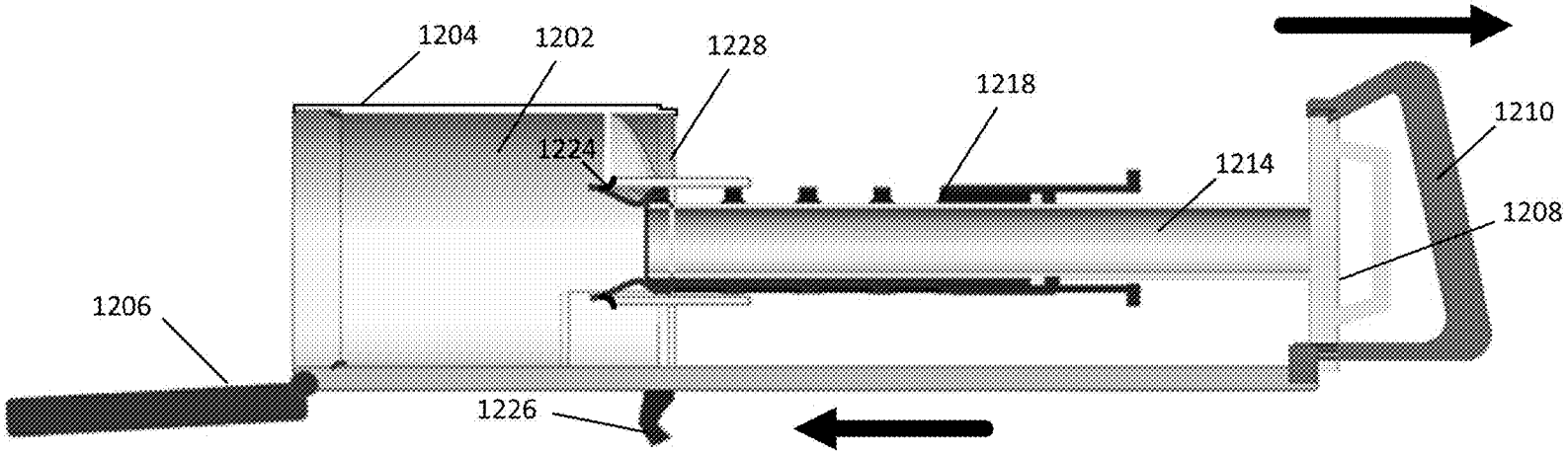

FIGS. 12A and 12B illustrate another example embodiment for a slidable waste receptacle design that can be used within any type of vacuum cleaner (stick, canister, etc.) As seen in FIG. 12A, the waste receptacle volume is again defined by a first housing section 1202 and a second housing section 1204. Similar to the design discussed above, first housing section 1202 may have a slightly smaller diameter compared to second housing section 1204, such that first housing section 1202 slides (e.g., axially translates) into one end of second housing section 1204. In some embodiments, the inner diameter of first housing section 1202 can be equal to, or less than, the outer diameter of second housing section 1204. There may be enough clearance between the two housing sections to allow telescoping of the two sections.

According to some embodiments, the waste receptacle may be capped by a receptacle door 1206 at one end and a top wall 1208 at the other end. A handle 1210 may be coupled to top wall 1208 and utilized during the emptying of the waste receptacle as described in more detail below. Second housing section 1204 may be fixed to a backbone 1212 that may extend to also couple with other vacuum cleaner elements (not shown).

According to some embodiments, an air suction tube 1214 extends through the waste receptacle, such as through the center of the waste receptacle. In the example state illustrated in FIG. 12A, air suction tube 1214 extends through both first housing section 1202 and a second housing section 1204. According to some embodiments, airflow may enter the waste receptacle through an inlet 1216, deposit any debris within the waste receptacle, and then enter through air suction tube 1214 via a mesh or screen 1218 around at least a portion of air suction tube 1214. Various flexible elements may be included within the waste receptacle to aid in scrapping any debris away from various surfaces or to create a seal between different moveable elements. For example, mesh or screen 1218 can include a flexible skirt 1220 at one end of mesh or screen 1218 and first housing section 1202 can include a gasket 1222 at the interface between the end of first housing section 1202 and the inner wall of second housing section 1204. Gasket 1222 provides a seal between the outer edge of first housing section 1202 and the inner edge of second housing section 1204. In some embodiments, gasket 1222 can also scrape along the inner wall of second housing section 1204 during the movement of first housing section 1202 into second housing section 1204. In another example, a wiper 1224 may be provided on a moveable backend portion of first housing section 1202. Wiper 1224 may be designed to wipe along the outside of mesh or screen 1218 as first housing section 1202 moves into second housing section 1204 to remove any debris clung to the outside of mesh or screen 1218. Each of flexible skirt 1220, gasket 1222, or wiper 1224 can include any compliant polymer material.

A slider grip 1226, which may be similar in form and function to slider grip 1106, may be designed to move along a track and cause a respective axial sliding movement of first housing section 1202. As illustrated in FIG. 12B, slider grip 1226 may be slid along a first direction to cause first housing section 1202 to slide within second housing section 1204. According to some embodiments, first housing section 1202 moves towards receptacle door 1206 at one end of second housing section 1204 by sliding within second housing section 1204. In some embodiments, a back wall 1228 of first housing section 1202 slides down the outside of mesh or screen 1218, thus removing (along with the aid of wiper 1224) any debris clinging to the outside surface of mesh or screen 1218. Accordingly, first housing section 1202 can move relative to mesh or screen 1218, which remains fixed in place.

According to some embodiments, once first housing section 1202 has begun its movement into second housing section 1204, receptacle door 1206 may be opened to release any contents within the waste receptacle. In some examples, receptacle door 1206 is manually opened by pulling the door open. In some examples, receptacle door 1206 is triggered to be opened automatically either by the initial movement of slider grip 1226 to begin moving first housing section 1202 into second housing section 1204 or by the movement itself of first housing section 1202 sliding across a proximal portion of second housing section 1204. In some embodiments, a mechanical catch or lever at either position is depressed or otherwise actuated to release receptacle door 1206.

According to some embodiments, movement of slider grip 1226 along a first direction is accompanied by pulling handle 1210 in a second opposite direction to pull air suction tube 1214 away from receptacle door 1206. Air suction tube 1214 may be coupled to top wall 1208, which in turn is coupled to handle 1210, such that handle 1210 can be used to provide a pulling force on air suction tube 1214 that pulls it away from the distal end of second housing section 1204. This retraction of air suction tube 1214 may be useful to remove any debris caught near the end of air suction tube 1214. Air suction tube 1214 can slide within mesh or screen 1218. Accordingly, air suction tube 1214 moves relative to mesh or screen 1218, which remains fixed in place, according to some embodiments.

Numerous specific details have been set forth herein to provide a thorough understanding of the embodiments. It will be understood in light of this disclosure, however, that the embodiments may be practiced without these specific details. In other instances, well known operations and components have not been described in detail so as not to obscure the embodiments. It can be appreciated that the specific structural and functional details disclosed herein may be representative and do not necessarily limit the scope of the embodiments. In addition, although the subject matter has been described in language specific to structural features and/or methodological acts, it is to be understood that the subject matter defined in the appended claims is not necessarily limited to the specific features or acts described herein. Rather, the specific features and acts described herein are disclosed as example forms of implementing the claims.

What is claimed is:

1. A vacuum cleaner, comprising:

a body having a longitudinal central axis and a substantially constant cross-sectional area along an entire length of the body extending from a proximal end to a distal end;

an air suction inlet at the distal end of the body;

a waste receptacle within the body and adjacent to the distal end of the body;

a motor housed in the body between the waste receptacle and the proximal end of the body; and a handle coupled to the proximal end of the body, wherein each of the waste receptacle, the air suction inlet, and the motor are substantially axially aligned with the longitudinal central axis of the body, and wherein the handle includes a grip that intersects the longitudinal central axis of the body, and wherein the waste receptacle includes a first housing section and a second housing section, the first housing section designed to fit within the second housing section.

2. The vacuum cleaner of claim 1, wherein the body comprises a first section and a second section along its length, the vacuum cleaner comprising a hinge disposed within the body and configured to rotate the second section of the body about the hinge.

3. The vacuum cleaner of claim 2, wherein the second section of the body is configured to rotate about the hinge such that the second section of the body is aligned substantially parallel to the first section of the body.

4. The vacuum cleaner of claim 1, wherein the entire length of the body is at least 75% of the entire length of the vacuum cleaner.

5. The vacuum cleaner of claim 1, wherein the first housing section is movable between a first proximal position to a second distal position along the longitudinal central axis of the body.

6. The vacuum cleaner of claim 1, further comprising a waste receptacle door at a distal end of the waste receptacle.

7. The vacuum cleaner of claim 6, wherein movement of the first housing section toward the distal end of the vacuum cleaner causes the waste receptacle door to open.

8. A waste receptacle configured for use on a vacuum cleaner, the waste receptacle comprising:

a first housing section having an inlet port; and a second housing section having an exit port, wherein the first housing section is designed to fit within the second housing section and is configured to slide within the second housing section.

9. The waste receptacle of claim 8, further comprising a waste receptacle door at the exit port of the second housing section.

10. The waste receptacle of claim 9, further comprising a slider coupled to the first housing section, wherein a longitudinal movement of the slider causes a corresponding longitudinal movement of the first housing section.

11. The waste receptacle of claim 10, wherein movement of the first housing section and/or the slider causes the waste receptacle door to open.

12. The waste receptacle of claim 8, wherein the second housing section is fixed to a backbone which is coupled to a body of the vacuum cleaner.

13. The waste receptacle of claim 12, wherein the backbone includes an air conduit fluidically coupled to the inlet port of the first housing section.

14. The waste receptacle of claim 8, further comprising an air suction tube that extends through at least a portion of the first housing section.

15. The waste receptacle of claim 14, wherein the air suction tube is fixedly attached to a body of the vacuum cleaner.

16. The waste receptacle of claim 14, wherein the air suction tube includes a plurality of openings through a wall of the air suction tube.

17. The waste receptacle of claim 14, wherein the first housing section is movable between a first proximal position to a second distal position.

18. The waste receptacle of claim 17, wherein the first housing section includes a wiper in contact with the air suction tube at the proximal end of the suction tube when the first housing section is in its first proximal position.

19. The waste receptacle of claim 18, wherein the first housing section is configured to move in a first direction from its first proximal position towards a distal end of the second hosing section, and the wiper of the first housing section in contact with the air suction tube is configured to wipe debris from the air suction tube and/or a mesh or screen on the air suction tube.

20. The waste receptacle of claim 14, wherein a flexible skirt is affixed to a distal end of the air suction tube.

* * * * *